US008859177B2

(12) United States Patent
Yoshizaki et al.

(10) Patent No.: US 8,859,177 B2
(45) Date of Patent: Oct. 14, 2014

(54) TONER

(75) Inventors: Kazumi Yoshizaki, Suntou-gun (JP); Yasushi Katsuta, Susono (JP); Kenichi Nakayama, Numazu (JP); Takeshi Kaburagi, Suntou-gun (JP); Hideki Kaneko, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 22 days.

(21) Appl. No.: 13/821,217

(22) PCT Filed: Sep. 6, 2011

(86) PCT No.: PCT/JP2011/070684

§ 371 (c)(1),
(2), (4) Date: Mar. 6, 2013

(87) PCT Pub. No.: WO2012/033221

PCT Pub. Date: Mar. 15, 2012

(65) Prior Publication Data

US 2013/0171552 A1 Jul. 4, 2013

(30) Foreign Application Priority Data

Sep. 8, 2010 (JP) ..... 2010-201067

(51) Int. Cl.
*G03G 9/08* (2006.01)
*G03G 9/087* (2006.01)

(52) U.S. Cl.
CPC ..... *G03G 9/08* (2013.01); *G03G 9/08782* (2013.01); *G03G 9/08795* (2013.01); *G03G 9/08797* (2013.01); *G03G 9/0825* (2013.01)
USPC ..... 430/108.8

(58) Field of Classification Search
CPC ..... G03G 9/08782
USPC ..... 430/108.8
See application file for complete search history.

(56) References Cited

U.S. PATENT DOCUMENTS

| | | | |
|---|---|---|---|
| 6,203,959 | B1 | 3/2001 | Tanikawa et al. |
| 7,432,030 | B2 | 10/2008 | Tsurumi et al. |

FOREIGN PATENT DOCUMENTS

| | | | |
|---|---|---|---|
| CN | 1117600 | A | 2/1996 |
| JP | 5-313403 | A | 11/1993 |
| JP | 2000-321815 | A | 11/2000 |
| JP | 2000-330332 | A | 11/2000 |
| JP | 2001-249486 | A | 9/2001 |
| JP | 2003-131418 | A | 5/2003 |
| JP | 2006-078689 | A | 3/2006 |
| JP | 2006-84661 | A | 3/2006 |
| WO | 2008/126865 | A1 | 10/2008 |
| WO | 2009/073512 | A1 | 6/2009 |

*Primary Examiner* — Mark A Chapman
(74) *Attorney, Agent, or Firm* — Canon U.S.A., Inc., IP Division

(57) ABSTRACT

The present invention provides a toner showing an excellent fixing property even in high-speed image formation and inhibiting contamination of the inside of an apparatus and thereby being capable of stably forming high-quality images not having unevenness of gloss over a long period of time. In the toner including toner particles containing a binder resin, an ester wax, and a coloring agent, the ester wax is prescribed by, in GC/MS analysis of components volatilized by heating the wax at 200° C. for 10 minutes, a relationship in the components having carbon atoms in specific ranges.

4 Claims, 4 Drawing Sheets

TONER

TECHNICAL FIELD

The present invention relates to a toner that is used in a recoding method such as electrophotography, an electrostatic recording method, or a toner-jetting system.

BACKGROUND ART

Recently, image forming devices such as printers are highly demanded to (1) show high fineness and high image quality, (2) achieve more energy saving than ever before, (3) increase the image forming speed, and (4) decrease the running cost. Based on this, the properties required in toners have been increasingly high and have become various, and toners have been developed from variety of viewpoints. Regarding the viewpoint of energy saving, there is a demand for developing a toner that is easily fixed to a transfer material such as paper at low temperature. At the same time, with an improvement in image resolution, there is a demand for controlling glossiness of images in order to improve the image quality to a level similar to those of photographs and printing. Furthermore, in a case of a color copier, there is a demand for a good color mixing property and broad color reproducibility.

PTL 1 discloses a toner that is excellent in mold releasability in fixing of a toner for low energy fixing and is inhibited from showing an offset phenomenon by using a resin having specific physical properties and a specific wax to control the properties of the binder resin and the wax. However, when image formation is repeated using the toner described in PTL 1, the wax contained in the toner causes another problem of contaminating the inside of image forming apparatuses. This is a marked tendency particularly in high-speed image formation.

Furthermore, PTL 2 discloses a toner that does not cause contamination of a heating roller in long-term use in an apparatus not having a heating roller-cleaning mechanism by simultaneously using three or more types of specific waxes. PTL 3 discloses a toner that prevents contamination of, in an image forming method by flash fixing, a flash lamp and a deodorizing filter due to volatilization/sublimation of low-molecular-weight components such as a wax by regulating physical properties of polyolefin in a black toner.

Furthermore, PTL 4 proposes a toner provided with an excellent fixing property by containing a wax having a low melting point and a sharp melting property, in which the content of n-paraffin is high. PTL 5 proposes a toner provided with excellent hot offset resistance by regulating the average number of carbon atoms of hydrocarbon components of a wax.

CITATION LIST

Patent Literature

PTL 1 Japanese Patent Laid-Open No. 2000-330332
PTL 2 Japanese Patent Laid-Open No. 2001-249486
PTL 3 Japanese Patent Laid-Open No. 2006-078689
PTL 4 Japanese Patent Laid-Open No. 2000-321815 (U.S. Pat. No. 6,203,959)
PTL 5 Japanese Patent Laid-Open No. 2006-084661 (U.S. Pat. No. 7,432,030)

SUMMARY OF INVENTION

Technical Problem

However, though the toner described in PTL 2 can inhibit contamination of the heating roller, inhibition of contamination of members in the vicinity of a fixing device is still insufficient. The image forming method described in PTL 3 is an invention relating to an image forming method using flash fixing. For example, in a pressure heating system with a heating roller or in a heat fixing method in which a pressure member adheres to a heated body through a film, sufficient improvement effects are not obtained. In addition, the toners described in PTLs 4 and 5 are excellent in, for example, fixing properties, but prevention of the inside of an apparatus from being contaminated in the fixing process is still insufficient.

Solution to Problem

The present invention provides a toner showing an excellent fixing property even in high-speed image formation and inhibiting contamination of the inside of an apparatus and thereby being capable of stably forming high-quality images not having unevenness of gloss over a long period of time.

The present invention relates to a toner including toner particles containing a binder resin, an ester wax, and a coloring agent, wherein in GC/MS analysis of components volatilized by heating the ester wax at 200° C. for 10 minutes, (1) a total amount (A) of components showing peaks that are detected on and after the detection time of the peak of hydrocarbon having 16 carbon atoms is 1000 ppm or less, (2) a total amount (B) of components showing peaks that are detected on and after the detection time of the peak of hydrocarbon having 30 carbon atoms is 200 ppm or less, (3) a total amount (C) of components showing peaks that are detected on and after the detection time of the peak of hydrocarbon having 16 carbon atoms and before the detection time of the peak of hydrocarbon having 24 carbon atoms is 300 ppm or less, (4) the total amount (B) and the total amount (C) satisfy a relationship expressed by $(C)/(B) \geq 1.0$, and (5) a total amount (E) of components showing peaks that are detected before the detection time of the peak of hydrocarbon having 16 carbon atoms is 500 ppm or less.

The present invention can provide a toner showing an excellent fixing property even in high-speed image formation and inhibiting contamination of the inside of an apparatus and thereby being capable of stably forming high-quality images not having unevenness of gloss over a long period of time.

DESCRIPTION OF EMBODIMENT

Figure 1:
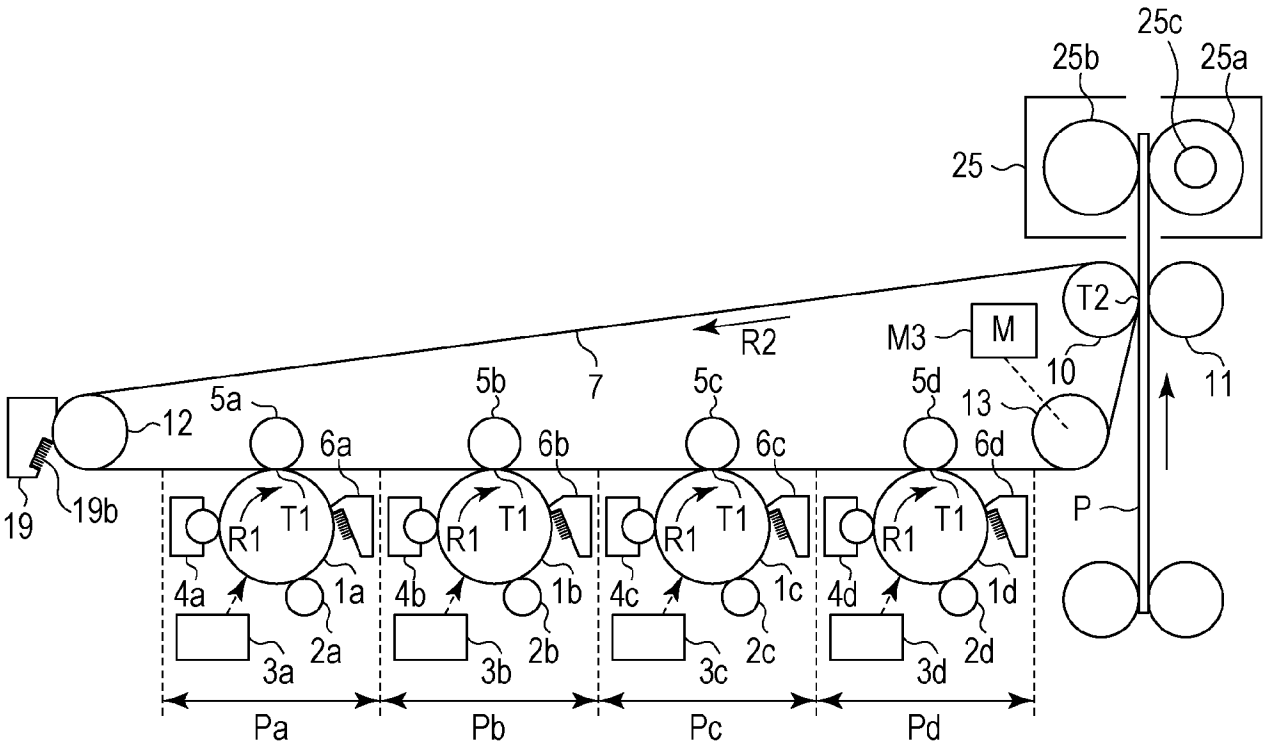
FIG. 1 is a cross-sectional view schematically illustrating an image forming apparatus.

In a high-speed fixing process, the toner needs to be molten instantly at a fixing nip portion. Accordingly, the fixing temperature is set to a high range, and thereby an excessive heat quantity is applied to the toner in many cases. According to the investigation by the present inventors, if continuous printing is performed at the state that an excessive heat quantity is being applied to the toner, a phenomenon that the concentration of a high-boiling-point volatile component from a wax is increased in the image forming apparatus is observed. The high-boiling-point volatile components are instantly cooled when they are brought into contact with structural members in the image forming apparatus and are thereby deposited. Accumulation of the deposited material causes contamination of the inside of the apparatus (hereinafter referred to as "inside contamination"), in particular, in the vicinity of a fixing device. The progress of inside contamination may cause a decrease in sensitivity of various control sensors and a decrease in ability of functional members such as the fixing members in the image forming apparatus. As a result, the image quality gradually decreases, which requires maintenance or replacement of the members and reduces the usable period of the image forming apparatus.

On the other hand, images printed on glossy paper are required to have high glossiness similar to that of photographs. Accordingly, in the output on glossy paper, a smooth fixing surface is accomplished by reducing the process speed to sufficiently melt the toner and letting the wax components uniformly spread on a molten resin surface. In also such fixing process conditions, the toner in the state that the wax has spread is heated for a long time. Therefore, the concentrations of the high-boiling-point volatile components from the wax are increased in the image forming apparatus to cause a tendency to accelerate the inside contamination.

The toner particles used in the present invention contain an ester wax. In general, the ester wax has polarity and is therefore highly compatible with styrene-acrylic resins and polyester resins, which are used as binder resins of toners. Because of such properties, the ester wax readily plasticizes resins and is therefore an effective wax for improving low-temperature fixing properties of toners.

Synthetic ester waxes, which are common ester waxes, are synthesized from higher alcohol components and higher carboxylic acid components in many cases. These higher alcohol components and higher carboxylic acid components are usually obtained from natural products and are generally mixtures of those having even numbers of carbon atoms. When these mixtures are directly esterified, various by-products having similar structures are generated in addition to target ester compounds. These ester waxes show a characteristic volatile component distribution when they are heated.

The present inventors have analyzed in detail the inside-contaminating components that are generated when the toner contains an ester wax and, as a result, have found that there is a relationship between the progress state of the inside contamination and the peak pattern on and after the detection time of the peak of hydrocarbon having 16 carbon atoms in GC/MS analysis of components volatilized by heating the ester wax at 200° C. for 10 minutes. This is thought that the relationship occurs because the above-mentioned heating conditions reproduce a state in which an excessive heat quantity is applied to a toner in the fixing process of high-speed image formation. In addition, as a result of further investigation, it has been revealed that, in particular, components corresponding to hydrocarbons having 30 or more carbon atoms in the above-mentioned peak pattern readily deposit as particles and are major causes of the inside contamination.

From the findings described above, it has been revealed that in order to reduce the inside contamination, it is necessary to reduce the total amount of high-boiling-point volatile components of the ester wax contained in toner particles and also reduce the amount of the volatile components corresponding to hydrocarbons having 30 or more carbon atoms in the high-boiling-point volatile components. Accordingly, the ester wax contained in the toner particles of the present invention is characterized in that in GC/MS analysis of components volatilized by heating the ester wax at 200° C. for 10 minutes, the total amount (A) of components showing peaks that are detected on and after the detection time of the peak of hydrocarbon having 16 carbon atoms is 1000 ppm or less, and the total amount (B) of components showing peaks that are detected on and after the detection time of the peak of hydrocarbon having 30 carbon atoms is 200 ppm or less. Note that in the present invention, "on and after the detection time of the peak of hydrocarbon having 16 carbon atoms" includes the detection time of the peak of hydrocarbon having 16 carbon atoms, and "on and after the detection time of the peak of hydrocarbon having 30 carbon atoms" includes the detection time of the peak of hydrocarbon having 30 carbon atoms.

The present invention has focused on that volatile components having 16 or more carbon atoms that are generated by heating the ester wax deposit as particles to contaminate the inside of an image forming apparatus. In this specification, the total amount (A) represents the ratio of the amount of high-boiling-point volatile components that are contained in the ester wax and cause the inside contamination. The amount of high-boiling-point volatile components that are generated from the ester wax is controlled to be low by controlling the total amount (A) to 1000 ppm or less, and thereby the amount of high-boiling-point volatile components that adhere to the inside of an image forming apparatus, such as a fixing member, can be reduced. Furthermore, the present invention has focused on that, in particular, among the high-boiling-point volatile components, the volatile components having 30 or more carbon atoms that are generated when the ester wax is heated readily deposit as particles and become major causes of the inside contamination. In addition, the generation of particles that cause inside contamination can be inhibited by controlling the total amount (B) to 200 ppm or less. By limiting the total amount (A) and the total amount (B) within the above-mentioned ranges, the present inventors arrived at the invention in that contamination of the inside of an image forming apparatus can be effectively inhibited, even in the cases of performing continuous output for a long time with a high-speed processing machine and of repeatedly printing on a large number of sheets such as heavy paper at a low-speed fixing mode.

The toner of the present invention needs to contain an ester wax characterized in that in GC/MS analysis of components volatilized by heating the ester wax at 200° C. for 10 minutes, the total amount (C) of components showing peaks that are detected on and after the detection time of the peak of hydrocarbon having 16 carbon atoms and before the detection time of the peak of hydrocarbon having 24 carbon atoms is 300 ppm or less. The total amount (C) can be 200 ppm or less, such as 100 ppm or less. In the volatile components causing the inside contamination, the volatile components represented by the total amount (C) are components having relatively low-boiling-points. A reduction in the amount of these components shows effects of decreasing the number of times (frequency) of contamination and of preventing spread of volatile components inside an apparatus. Note that in the present invention, "before the detection time of the peak of hydrocarbon having 24 carbon atoms" excludes the detection time of the peak of hydrocarbon having 24 carbon atoms.

Furthermore, in the present invention, it is necessary to use an ester wax in which the total amount (B) and the total amount (C) satisfy a relationship: $(C)/(B) \geq 1.0$. It is believed that since the ratio of volatile components represented by the total amount (C) to the volatile components represented by the total amount (B) is high to some extent if the value of (C)/(B) is within the above-mentioned range, generation of the volatile components represented by the total amount (B) is inhibited by the steam pressure of the components represented by the total amount (C) already volatilized. As a result, the effect of inhibiting the inside contamination can be further enhanced. The value of (C)/(B) can be 1.3 or higher, such as 1.5 or higher.

The toner of the present invention can contain an ester wax characterized in that, in GC/MS analysis of components volatilized by heating the ester wax at 200° C. for 10 minutes, when a total amount of components showing peaks that are detected on and after the detection time of the peak of hydrocarbon having 24 carbon atoms and before the detection time of the peak of hydrocarbon having 30 carbon atoms is represented by a total amount (D), the total amount (C) and the total amount (D) can satisfy a relationship expressed by (C)/(D) ≥0.5. The volatile components represented by the total amount (D) are components having relatively middle-boiling-points and cause the inside contamination, though the degree of contamination is not high as that by the volatile components represented by the total amount (B). It is believed that as long as the value of (C)/(D) is within the above-mentioned range, generation of the volatile components represented by the total amount (D) is inhibited by the steam pressure of the components represented by the total amount (C) already volatilized. As a result, generation and diffusion of the volatile components represented by the total amount (D) are inhibited, preventing the accumulation portion of contamination from broadly spreading. Note that in the present invention, "before the detection time of the peak of hydrocarbon having 30 carbon atoms" excludes the detection time of the peak of hydrocarbon having 30 carbon atoms.

The toner of the present invention needs to contain an ester wax characterized in that in GC/MS analysis of components volatilized by heating the ester wax at 200° C. for 10 minutes, the total amount (E) of components showing peaks that are detected before the detection time of the peak of hydrocarbon having 16 carbon atoms is 500 ppm or less. The volatile components represented by the total amount (E) are components having high volatility and are thought to hardly contribute to the inside contamination. However, if the concentration of the volatile components represented by the total amount (E) in the air in the vicinity of a fixing device is increased, the life span of the fixing device may be decreased by chemical attack by the volatile components, or the gloss of an image may become uneven. By regulating the total amount (E) in the above-mentioned range, these effects on the fixing device and the image can be inhibited. Note that in the present invention, "before the detection time of the peak of hydrocarbon having 16 carbon atoms" excludes the detection time of the peak of hydrocarbon having 16 carbon atoms.

Measurement of Volatile Component Concentration in Wax Using Thermal Desorption Apparatus The concentrations of volatile components in the wax in the present invention are measured as follows. As the measurement apparatus, the following apparatuses are used:

Thermal desorption apparatus: TurboMatrix ATD (manufactured by Perkin-Elmer Corp.), and GC/MS: TRACE DSQ (manufactured by Thermo Fisher Scientific Inc.).

Thermal Desorption in the Measurement of Volatile Component Concentration is Performed by an Auto Thermal Desorption (ATD) Method.

Preparation of Glass Tube Containing Internal Standard Substance

A glass tube packed with 10 mg of Tenax TA adsorbent held by glass-wool is prepared in advance for a thermal desorption apparatus, and the tube is subjected to conditioning at 300° C. for 3 hours under a flow of an inert atmospheric gas. Then, 5 μL of a solution of 100 ppm deuterated n-hexadecane (n-hexadecane D34) in methanol is subjected to adsorption to Tenax TA to obtain a glass tube containing the internal standard substance.

Note that in the present invention, deuterated n-hexadecane, which shows a peak at a retention time different from that of the n-hexadecane peak, is used as the internal standard substance in order to distinguish the peak from the peak of n-hexadecane contained in a wax to be analyzed and that the concentrations of volatile components in the present invention are all deuterated n-hexadecane equivalents. The conversion process of the concentrations of volatile components will be described below.

Measurement of Wax

About 10 mg of a wax weighed and wrapped with aluminum foil burned at 300° C. in advance is put in a dedicated tube prepared in the "Preparation of glass tube containing internal standard substance". The tube is closed with a Teflon (registered trademark) cap for a thermal desorption apparatus, and this sample is set to the thermal desorption apparatus. The sample is subjected to measurement under the following conditions, and the retention time and peak area b1 of the volatile component from the internal standard substance and the total area of peaks excluding the peak of the volatile component from the internal standard substance are calculated.

Thermal Desorption Apparatus Conditions

Tube temperature: 200° C.

Transfer temperature: 300° C.

Valve temperature: 300° C.

Column pressure: 150 kPa

Inlet split: 25 mL/min

Outlet split: 10 mL/min

Secondary adsorption tube material: Tenax TA

Retention time: 10 min

Secondary adsorption tube temperature after desorption: −30° C.

Secondary adsorption tube desorption temperature: 300° C.

GC/MS conditions

Column: Ultra alloy (metal column) UT-5 (internal diameter: 0.25 mm, liquid phase: 0.25 μm, length: 30 m)

Column temperature-rising conditions: 60° C. (retention time: 3 min), temperature rising from 60° C. to 350° C. (temperature-rising rate: 20.0° C./min), 350° C. (retention time: 10 min)

Note that the GC column is directly connected to the transfer line of the thermal desorption apparatus, and the inlet of the GC column is not used.

Analysis

All peaks on and after the retention time of n-hexadecane, excluding the peak of deuterated n-hexadecane serving as an internal standard substance, obtained by the above-described procedure are integrated to calculate the total area of all peaks. Then, the concentrations of volatile components of a wax are calculated by the following expression. In this occasion, it is necessary to pay attention not to add noise peaks differing from the peaks to the integration value.

$$\text{Volatile component concentration in wax (ppm)}=\{(a1/b1)\times(0.0005^{*1}\times0.77^{*2})/c1\}\times1000000$$

a1: total peak area on and after n-hexadecane (excluding the peak of deuterated n-hexadecane), b1: peak area of deuterated n-hexadecane (internal standard substance), c1: weight (mg) of the weighed wax,

*1: volume (IL) of the internal standard substance in 5 μL of a methanol solution, and

*2: density of deuterated n-hexadecane (internal standard substance).

The value obtained by the above-mentioned analysis is defined as the total amount (A) of components showing peaks that are detected on and after the detection time of the peak of hydrocarbon having 16 carbon atoms. Furthermore, the total amount (B), the total amount (C), the total amount (D), and the total amount (E) are calculated as follows. Regarding the total amount (B), first, the retention time of n-triacontane (carbon atom number: 30) is measured in advance. Then, in the GC/MS analysis results of components volatilized by the thermal desorption apparatus, all peaks detected on and after the retention time of n-triacontane (carbon atom number: 30) are integrated to calculate the total area a2 of the all peaks detected on and after the detection time of the peak of hydrocarbon having 30 carbon atoms. The value obtained by changing the a1 in the above-mentioned expression to the a2 is defined as the total amount (B).

Regarding the total amount (C), first, the retention time of n-tetracosane (carbon atom number: 24) is measured in advance. Then, in the GC/MS analysis results of components volatilized by the thermal desorption apparatus, all peaks detected after the retention time of deuterated n-hexadecane (carbon atom number: 16) (excluding the peak of deuterated n-hexadecane) and before the retention time of n-tetracosane (carbon atom number: 24) are integrated. The total area a3 of the peaks is calculated, and the value obtained by changing the a1 in the above-mentioned expression to the a3 is defined as the total amount (C).

Regarding the total amount (D), in the GC/MS analysis results of components volatilized by the thermal desorption apparatus, all peaks detected on and after the retention time of n-tetracosane (carbon atom number: 24) and before the retention time of n-triacontane (carbon atom number: 30) are integrated. The total area a4 of the peaks is calculated, and the value obtained by changing the a1 in the above-mentioned expression to the a4 is defined as the total amount (D).

Regarding the total amount (E), all peaks detected before the retention time of n-hexadecane (carbon atom number: 16) (excluding the peak of deuterated n-hexadecane) are integrated. The total area a5 of the peaks is calculated, and the value obtained by changing the a1 in the above-mentioned expression to the a5 is defined as the total amount (E).

In an endothermic curve obtained by differential scanning calorimetry (DSC) measurement of the ester wax contained in the toner of the present invention, the peak width at half height of the maximum endothermic peak can be 5° C. or less. By doing so, the inside contamination can be effectively reduced.

In addition, in the toner of the present invention, the peak top temperature of the maximum endothermic peak in the DSC measurement can be 55° C. or more and 90° C. or less. By doing so, the formation of inside contamination can be reduced, and the image forming apparatus can be used over a long period. In addition, even in high-speed apparatuses, offset preventing effect can be excellent. In the toner of the present invention, the endothermic amount of the endothermic peak in DSC measurement can be 2.0 J/g or more and 20.0 J/g or less. By controlling the endothermic peak of a toner within this range, an image having uniform and stable gloss can be obtained, and also development stability and effect of inhibiting inside contamination are also enhanced.

The ester wax content in the toner of the present invention can be 1.0 part by mass or more and 25.0 parts by mass or less, such as 5.0 parts by mass or more and 25.0 parts by mass or less, or 7.0 parts by mass or more and 25.0 parts by mass or less, based on 100 parts by mass of the binder resin. By controlling the content of the wax within the above-mentioned range, a toner that shows effective fixing properties and also gives sufficient development quality even for images formed on a large number of sheets can be obtained.

The ester wax used in the present invention can be any ester wax having at least one ester bond in one molecule and may be a natural wax or a synthetic wax.

The ester wax used in the present invention can have a weight-average molecular weight (Mw) of 350 or more and 5000 or less when measured by gel permeation chromatography (GPC). By doing so, both a good low-temperature fixing property and high offset resistance can be achieved.

Examples of the synthetic ester wax include esters of straight-chain fatty acids and straight-chain aliphatic alcohols, more specifically, monoester waxes synthesized from long straight-chain saturated fatty acids and long straight-chain saturated alcohols. The long straight-chain saturated fatty acid is generally represented by a general formula: $C_nH_{(2n+1)}COOH$, wherein n can be an integer of 5 to 28. The long straight-chain saturated alcohol is generally represented by a general formula: $C_nH_{(2n+1)}OH$, wherein n can be an integer of 5 to 28. Specific examples of the long straight-chain saturated fatty acid include capric acid, undecylic acid, lauric acid, tridecylic acid, myristic aid, palmitic acid, pentadecylic acid, heptadecanoic acid, tetradecanoic acid, stearic acid, nonadecanoic acid, arachic acid, behenic acid, lignoceric acid, cerotic acid, heptacosanoic acid, montanic acid, and melissic acid. Specific examples of the long straight-chain saturated alcohol include amyl alcohol, hexyl alcohol, heptyl alcohol, octyl alcohol, capryl alcohol, nonyl alcohol, decyl alcohol, undecyl alcohol, lauryl alcohol, tridecyl alcohol, myristyl alcohol, pentadecyl alcohol, cetyl alcohol, heptadecyl alcohol, stearyl alcohol, nonadecyl alcohol, eicosyl alcohol, ceryl alcohol, and heptadecanol.

Examples of the ester wax having two or more ester bonds in one molecule include trimethylolpropane tribehenate, pentaerythritol tetrabehenate, pentaerythritol diacetate dibehenate, glycerin tribehenate, and 1,18-octadecanediol-bis-stearate; and polyalkanol esters such as tristearyl trimellitate and distearyl maleate.

Examples of the natural ester wax include candelilla wax, carnauba wax, rice wax, vegetable wax, jojoba oil, bees wax, lanoline, caster wax, montan wax, and derivatives thereof.

Among the above-mentioned examples of the wax, particularly, an ester wax constituted of a straight-chain fatty acid and a straight-chain aliphatic alcohol and containing reduced amounts of high-boiling-point volatile components by purification can be used. Examples of the methods for purifying raw materials and wax products include solvent extraction, a reduced pressure distillation method, a press sweating method, a recrystallization method, a vacuum distillation method, a molecular distillation method, a short path distillation method, a supercritical gas extraction method, and a melt crystallization method. In particular, the distillation of a wax can be performed by a combination of the short path distillation method and the molecular distillation method.

For example, distillation can be performed as follows. A wax as a raw material is subjected to short path distillation under conditions of a pressure of 1 to 10 Pa and a temperature of 180 to 250° C., and a process of removing the initial fraction is repeated to obtain the wax fraction. Subsequently, the wax fraction is subjected to molecular distillation under conditions of a pressure of 0.1 to 0.5 Pa and a temperature of 150 to 250° C. to remove hydrocarbon components that cause inside contamination.

According to the investigation by the present inventors, it has been revealed that the high-boiling-point volatile components can be efficiently removed by the molecular distillation when distillation residues as well as the initial fraction components are removed in advance by the short path distillation.

An example of the short path distillation apparatus particularly suitable for the present invention is a wiped-film distillation apparatus.

In order to supplement the mold release effect and the plasticization effect of the resin, in addition to the ester wax, a polar wax may be used. Examples of such a wax include alcohol waxes, fatty acid waxes, acid amide waxes, ketone waxes, hydrogenated castor oil and their derivatives. In these waxes, oxides, block copolymers with vinyl monomers, and graft-modified products are included as derivatives. Furthermore, in order to supplement the developability and offset resistance, a hydrocarbon wax may be simultaneously contained. Examples of the hydrocarbon wax include polyolefins purified from low-molecular-weight by-products generated during polymerization of high-molecular-weight polyolefins; polyolefins polymerized using a catalyst such as a Ziegler catalyst or a metallocene catalyst; paraffin waxes, Fischer-Tropsch waxes, and microcrystalline waxes; synthetic hydrocarbon waxes synthesized by a synthol method, a hydrocoal method, or an Arge method from, e.g., coal or natural gas; synthetic waxes obtained from a monomer compound having one carbon atom; hydrocarbon waxes having functional groups such as a hydroxyl group and a carboxyl group; and mixtures of a hydrocarbon wax and a hydrocarbon wax having a functional group. It is effective to use these polar wax and the hydrocarbon wax in an amount of 2.0 parts by mass or more and 35.0 parts by mass or less, such as 6.0 parts by mass or more and 35.0 parts by mass or less, or 8.0 parts by mass or more and 35.0 parts by mass or less, as the total amount with the ester wax used in the present invention, based on 100.0 parts by mass of the binder resin.

Examples of the binder resin contained in the toner include the following polymers: polystyrenes; single polymers of styrene substitutes such as poly(p-chlorostyrene) or poly(vinyl toluene); styrene copolymers such as styrene-p-chlorostyrene copolymers, styrene-vinyl toluene copolymers, styrene-vinylnaphthalene copolymers, styrene-acrylic acid ester copolymers, styrene-methacrylic acid ester copolymers, styrene-methyl α-chloromethacrylate copolymers, styrene-acrylonitrile copolymers, styrene-vinyl methyl ether copolymers, styrene-vinyl ethyl ether copolymers, styrene-vinyl methyl ketone copolymers, styrene-butadiene copolymers, styrene-isoprene copolymers, and styrene-acrylonitrile-indene copolymers; and poly(vinyl chloride), phenol resins, natural modified phenolic resins, natural resin-modified maleic acid resins, acrylic resins, methacrylic resins, poly(vinyl acetate), silicone resins, polyester resins, polyurethane, polyamide resins, furan resins, epoxy resins, xylene resins, poly(vinyl butyral), terpene resins, coumarone-indene resins, and petroleum resins. In particular, a styrene copolymer or a polyester resin can be used as the binder resin.

Examples of the comonomer to the styrene monomer of the styrene copolymer include monocarboxylic acids having a double bond and substitutes thereof such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond and substitutes thereof such as maleic acid, butyl maleate, methyl maleate, and dimethyl maleate; vinyl esters such as vinyl chloride, vinyl acetate, and vinyl benzoate; ethylene olefins such as ethylene, propylene, and butylene; vinyl ketones such as vinyl methyl ketone and vinyl hexyl ketone; and vinyl ethers such as vinyl methyl ether, vinyl ethyl ether, and vinyl isobutyl ether. These vinyl monomers may be used alone or in combination. The styrene homopolymer or styrene copolymer may be cross-linked or may be mixed.

As the cross-linking agent of the binder resin, a compound having two or more polymerizable double bonds can be mainly used, and examples thereof include aromatic divinyl compounds such as divinyl benzene and divinyl naphthalene; carboxylic acid esters having two double bonds such as ethylene glycol diacrylate, ethylene glycol dimethacrylate, and 1,3-butanediol dimethacrylate; divinyl compounds such as divinyl aniline, divinyl ether, divinyl sulfide, and divinyl sulfone; and compounds having three or more vinyl groups. These cross-linking agents may be used alone or as a mixture. The styrene copolymers may be synthesized by any of bulk polymerization, solution polymerization, suspension polymerization, and emulsion polymerization.

Next, the composition of a polyester resin that can be used as the binder resin will be described. Examples of the divalent alcohol component include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenol represented by formula (A) and derivatives thereof:

[Chem. 1]

(A)

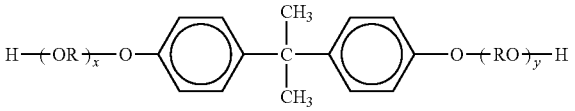

(in the formula, R represents an ethylene or propylene group; x and y are each an integer of 0 or larger; and the mean value of x+y is 0 to 10), and diols represented by formula (B):

[Chem. 2]

(B)

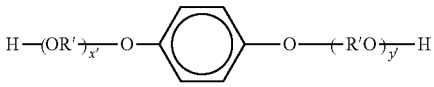

(in the formula, R' represents —$CH_2CH_2$— or the following formula:

[Chem. 3]

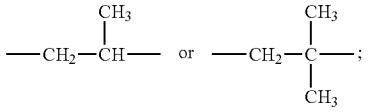

x' and y' are each an integer of 0 or larger; and the mean value of x'+y' is 0 to 10).

The divalent acid component is a dicarboxylic acid or its derivative, and examples thereof include benzenedicarboxylic acids, such as phthalic acid, terephthalic acid, isophthalic acid, and phthalic anhydride, and anhydrides or lower alkyl esters thereof; alkyldicarboxylic acids, such as succinic acid, adipic acid, sebacic acid, and azelaic acid, and anhydrides or lower alkyl esters thereof; alkenyl succinic acids or alkyl succinic acids, such as n-dodecenyl succinic acid and n-dodecyl succinic acid, and anhydrides or lower alkyl esters thereof; and unsaturated dicarboxylic acids, such as fumaric acid, maleic acid, citraconic acid, and itaconic acid, and anhydrides or lower alkyl esters thereof.

Furthermore, both a tri- or higher valent alcohol component also serving as a cross-linking component and a tri- or higher valent acid component can be contained. The tri- or higher valent polyhydric component is a multivalent carboxylic acid or its derivative, and examples thereof include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxybenzene. Examples of the tri- or higher valent carboxylic acid component include trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, and Empol trimer acid, and anhydrides or lower alkyl esters thereof; tetracarboxylic acids represented by the following formula:

[Chem. 4]

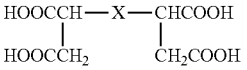

(in the formula, X represents an alkylene group or an alkenylene group having one or more side chain of one or more carbon atoms and having 1 to 30 carbon atoms), and anhydrides or lower alkyl esters thereof. On the basis of the total mole number of the total components, the amount of the alcoholic component can be 40 to 60% by mole, such as 45 to 55% by mole, and the amount of the acid component can be 40 to 60% by mole, such as 45 to 55% by mole. The tri- or more valent components can be 1 to 60% by mole. A polyester resin can be obtained by generally known condensation polymerization using the above-mentioned alcohol component and acid component.

The glass transition point (Tg) of the binder resin contained in the toner of the present invention can be 45 to 65° C., such as 50 to 55° C.

The toner of the present invention includes a coloring agent for exhibiting its coloring ability. Examples of the coloring agent that can be used in the present invention include the following organic pigments, organic dyes, and inorganic pigments.

As the organic pigment or the organic dye serving as a cyan coloring agent, a copper phthalocyanine compound, a derivative thereof, an anthraquinone compound, or a basic dye chelate compound can be used. Specific examples thereof include C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60, C.I. Pigment Blue 62, and C.I. Pigment Blue 66.

Examples of the organic pigment or the organic dye serving as a magenta coloring agent include condensed azo compounds, diketopyrrolopyrrole compounds, anthraquinone, quinacridone compounds, basic dye chelate compounds, naphthol compounds, benzimidazolone compounds, thioindigo compounds, and perylene compounds. Specific examples thereof include C.I. Pigment Red 2, C.I. Pigment Red 3, C.I. Pigment Red 5, C.I. Pigment Red 6, C.I. Pigment Red 7, C.I. Pigment Violet 19, C.I. Pigment Red 23, C.I. Pigment Red 48:2, C.I. Pigment Red 48:3, C.I. Pigment Red 48:4, C.I. Pigment Red 57:1, C.I. Pigment Red 81:1, C.I. Pigment Red 122, C.I. Pigment Red 144, C.I. Pigment Red 146, C.I. Pigment Red 150, C.I. Pigment Red 166, C.I. Pigment Red 169, C.I. Pigment Red 177, C.I. Pigment Red 184, C.I. Pigment Red 185, C.I. Pigment Red 202, C.I. Pigment Red 206, C.I. Pigment Red 220, C.I. Pigment Red 221, and C.I. Pigment Red 254.

As the organic pigment or the organic dye serving as a yellow coloring agent, a compound represented by a condensed azo compound, an isoindolinone compound, an anthraquinone compound, an azo metal complex, a methine compound, or an allylamide compound can be used. Specific examples thereof include C.I. Pigment Yellow 12, C.I. Pigment Yellow 13, C.I. Pigment Yellow 14, C.I. Pigment Yellow 15, C.I. Pigment Yellow 17, C.I. Pigment Yellow 62, C.I. Pigment Yellow 74, C.I. Pigment Yellow 83, C.I. Pigment Yellow 93, C.I. Pigment Yellow 94, C.I. Pigment Yellow 95, C.I. Pigment Yellow 97, C.I. Pigment Yellow 109, C.I. Pigment Yellow 110, C.I. Pigment Yellow 111, C.I. Pigment Yellow 120, C.I. Pigment Yellow 127, C.I. Pigment Yellow 128, C.I. Pigment Yellow 129, C.I. Pigment Yellow 147, C.I. Pigment Yellow 151, C.I. Pigment Yellow 154, C.I. Pigment Yellow 155, C.I. Pigment Yellow 168, C.I. Pigment Yellow 174, C.I. Pigment Yellow 175, C.I. Pigment Yellow 176, C.I. Pigment Yellow 180, C.I. Pigment Yellow 181, C.I. Pigment Yellow 191, and C.I. Pigment Yellow 194.

As a black coloring agent, a carbon black, a magnetic substance, or a black mixture of the above-mentioned yellow, magenta, and cyan coloring agents is used.

These coloring agents may be used alone, in admixture, or in a state of solid solution. The coloring agent is selected from the viewpoints of hue angle, saturation, brightness, light resistance, OHP transparency, and dispersibility into the toner. The coloring agents excluding the magnetic substance can be added in an amount of 1 part by mass or more and 20 parts by mass or less based on 100 parts by mass of the binder resin.

The toner of the present invention can be used as a magnetic toner containing a magnetic substance as a black coloring agent. In such a case, the magnetic substance can also function as a coloring agent. Examples of the magnetic substance include iron oxides such as magnetite, hematite, and ferrite; and metals such as iron, cobalt, and nickel and their alloys and mixtures with metals such as aluminum, cobalt, copper, lead, magnesium, tin, zinc, antimony, beryllium, bismuth, cadmium, calcium, manganese, selenium, titanium, tungsten, and vanadium. The magnetic substance can be a surface modified magnetic substance. When the magnetic toner is prepared by polymerization, the magnetic substance can be one subjected to hydrophobization treatment by a surface modifier that does not prevent the polymerization. Examples of the surface modifier include silane coupling agents and titanate coupling agents. These magnetic substances can have a number-average particle diameter of 2 μm or less, such as 0.1 μm or more and 0.5 μm or less. The amount of the magnetic substance contained in toner particles can be 20 parts by mass or more and 200 parts by mass or less based on 100 parts by mass of the polymerizable monomer or the binder resin, such as 40 parts by mass or more and 150 parts by mass or less based on 100 parts by mass of the binder resin.

In the toner of the present invention, a charge control agent can be optionally mixed with the toner particles. By blending a charge control agent, the charge characteristics are stabilized, and frictional electrification amount can be optimized according to the development system. Any known charge control agent, in particular, a charge control agent that shows a high frictional electrification speed and stably maintains a constant frictional electrification amount, can be used. Examples of the charge control agent that controls the toner to a negative charge include organometallic compounds, chelate compounds, monoazo metal compounds, acetylacetone metal compounds, aromatic oxycarboxylic acids, aromatic dicarboxylic acids, and metal compounds of oxycarboxylic acids and dicarboxylic acids; aromatic oxycarboxylic acids and aromatic mono- and poly-carboxylic acids, and their metal salts, anhydrides, esters, and phenol derivatives such as bisphenol; urea derivatives; metal-containing salicylic acid compounds; metal-containing naphthoic aid compounds; boron compounds; quaternary ammonium salts; calixarene; and resin charge control agents. Examples of the charge control agent that controls the toner to a positive charge include nigrosine and products of nigrosine modified with fatty acid metal salts; guanidine compounds; imidazole compounds; quaternary ammonium salts such as tributylbenzyl ammonium-1-hydroxy-4-naphthosulfonate and tetrabutyl ammonium tetrafluoroborate, their analogs, that is, onium salts such as phosphonium salts, and lake pigments thereof; triphenylmethane dyes and lake pigments thereof (the laking agents include phosphotungstic acid, phosphomolybdic acid, phosphotungsten molybdic acid, tannic acid, lauric acid, gallic acid, ferricyanates, and ferrocyanates); metal salts of higher aliphatic acids; and resin charge control agents. These charge control agents can be contained in the toner of the present invention alone or in combination of two or more thereof. Among these charge control agents, from the viewpoints of charge rise-up properties and charge stability, metal-containing salicylic acid compounds, in particular, aluminum or zirconium-containing salicylic acid, can be used. Particularly, an aluminum 3,5-di-tert-butylsalicylate compound can be used as the charge control agent. The charge control agent can be blended in an amount of 0.01 parts by mass or more and 5 parts by mass or less, such as 0.05 parts by mass or more and 4.5 parts by mass or less, based on 100 parts by mass of the binder resin.

Furthermore, a charge control resin can be optionally contained for supplementing charge-retaining ability. As the charge control resin, a polymer having a side chain of a sulfonic acid group, a sulfonate group, or a sulfonic acid ester group can be used. In particular, a polymer or a copolymer of a sulfonic acid group, a sulfonate group, or a sulfonic acid ester group can be used. Examples of a monomer having a sulfonic acid group, a sulfonate group, or a sulfonic acid ester group for producing the charge control resin include styrenesulfonic acid, 2-acrylamide-2-methylpropane sulfonic acid, 2-methacrylamide-2-methylpropane sulfonic acid, vinyl sulfonic acid, methacrylsulfonic acid, and alkyl esters thereof.

The polymer containing a sulfonic acid group, a sulfonate group, or a sulfonic acid ester group may be a homopolymer of the above-mentioned monomer or a copolymer of the above-mentioned monomer and another monomer. The monomer that forms the copolymer together with any of the above-mentioned monomers can be a vinyl polymerizable monomer, and also the monofunctional polymerizable monomers or multifunctional polymerizable monomers exemplified in the explanation of the binder resin components can be used. The content of the polymer having, for example, a sulfonic acid group can be 0.01 parts by mass or more and 5.00 parts by mass or less, such as 0.10 parts by mass or more and 3.00 parts by mass or less, based on 100 parts by mass of the polymerizable monomer or the binder resin. When the polymer having, for example, a sulfonic acid group is contained in an amount within the above-mentioned range, the charge stabilizing effect can be sufficiently shown to give excellent environmental characteristics and durability characteristics.

When the toner particles are produced by suspension polymerization, a polar resin can be added in the polymerization reaction during the process from dispersion to polymerization. In such a case, the state of the polar resin can be controlled according to the polar balance existing between the polymerizable monomer composition, which form toner particles, and the aqueous dispersion medium. That is, it is possible to form a shell of a thin layer of the polar resin on the surfaces of the toner particles or to let the polar resin be present on the surfaces of the toner particles with inclination toward the center. In addition, by adding the polar resin, the strength of the shell portion of a core shell structure can be freely controlled. Accordingly, the development durability and fixing property of the toner can be optimized.

Examples of the polar resin include polymers of nitrogen-containing monomers such as dimethylaminoethyl methacrylate and diethylaminoethyl methacrylate or copolymers of nitrogen-containing monomers and styrene-unsaturated carboxylic acid esters; polymers of nitrile monomers such as acrylonitrile, halogen monomers such as vinyl chloride, unsaturated carboxylic acids such as acrylic acid and methacrylic acid, unsaturated dibasic acids, unsaturated dibasic acid anhydrides, or nitro monomers or copolymers thereof with styrene monomers or styrene copolymers such as styrene-acrylic acid copolymers, styrene-acrylic acid ester copolymers, styrene-methacrylic acid copolymers, styrene-methacrylic acid ester copolymers, and styrene-maleic acid copolymers; polyester resins; and epoxy resins. These polar resins may be used alone or in combination.

The polar resin can have a weight-average molecular weight (Mw) measured by gel permeation chromatography (GPC) of 5000 to 30000 and a ratio (Mw/Mn) of the weight-average molecular weight to the number-average molecular weight of 1.05 to 5.00, such as a weight-average molecular weight (Mw) of 8000 to 20000. Furthermore, the polar resin can have a glass transition temperature (Tg) of 60 to 100° C. and an acid value (Av) of 5 to 30 mg KOH/g. The content of the polar resin can be 5 to 40 parts by mass, such as 5 to 30 parts by mass, based on 100 parts by mass of the polymerizable monomer or the binder resin.

When the toner particles are produced by polymerization, a polymerization initiator showing a half-life of 0.5 to 30 hours in the production of the toner particles can be used in an amount of 0.5 to 20 parts by mass based on 100 parts by mass of the polymerizable monomer and can provide desired strength and appropriate melting characteristics to the toner. Examples of the polymerization initiator include azo or diazo polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile; and peroxide polymerization initiators such as benzoyl peroxide, methyl ethyl ketone peroxide, diisopropyl peroxycarbonate, cumene hydroperoxide, 2,4-dichlorobenzoyl peroxide, lauroyl peroxide, and t-butylperoxy-2-ethyl hexanoate.

When the toner particles are produced by polymerization, a cross-linking agent can be added, and the content thereof can be 0.001 to 15% by mass of the polymerizable monomer composition. As the cross-linking agent, a compound having two or more polymerizable double bonds can be mainly used, and examples thereof include aromatic divinyl compounds such as divinyl benzene and divinyl naphthalene; carboxylic acid esters having two double bonds such as ethylene glycol diacrylate, ethylene glycol dimethacrylate, and 1,3-butanediol dimethacrylate; divinyl compounds such as divinyl aniline, divinyl ether, divinyl sulfide, and divinyl sulfone; and compounds having three or more vinyl groups. These cross-linking agents may be used alone or as a mixture.

The toner of the present invention can contain an inorganic fine powder such as silica, alumina, or titania for improving frictional electrification stability, developability, fluidity, and durability. The main component of the inorganic fine powder to be added can be silica, in particular, silica fine powders having a number-average primary particle diameter of 4 nm or more and 80 nm or less. When the number-average primary particle diameter is within the above-mentioned range, the fluidity of the toner and also the storage stability of the toner are improved. The number-average primary particle diameter of the inorganic fine powder is measured as follows. The inorganic fine powder is observed with a scanning electron microscope, and the particle diameters of 100 particles in the viewing field are measured, and the average particle diameter thereof is calculated. In addition, the inorganic fine powder may be a combination of silica with, for example, titanium oxide, alumina, or a complex oxide thereof, in particular, a combination of silica and titanium oxide. Examples of the silica as the inorganic fine powder include dry silica or dry silica referred to as humed silica generated by vapor-phase oxidation of a silicon halide and wet silica produced from water glass. The dry silica in which the amount of silanol groups on the surfaces and inside thereof is small and also the amount of $Na_2O$ and $SO_3^{2-}$ production residues is small can be used as the inorganic fine powder. Furthermore, the dry silica can be obtained as a fine powder composite of silica and another metal oxide by using another metal halide such as aluminum chloride or titanium chloride together with a silicon halide in the production process.

The inorganic fine powder is added for improving the fluidity of the toner and uniformizing the frictional electrification. Since hydrophobization treatment of the inorganic fine powder can achieve functions such as regulation of the frictional electrification amount of the toner, improvement of environmental stability, and improvement of characteristics under high-humidity environments, hydrophobized inorganic fine powder can be used. When the inorganic fine powder contained in a toner absorbs moisture, the frictional electrification amount as the toner decreases, and the developability and transcription ability tend to decrease.

Examples of the treatment agent for the hydrophobization treatment of the inorganic fine powder include unmodified silicone varnishes, various types of modified silicone varnishes, unmodified silicone oils, various types of modified silicone oils, silane compounds, silane coupling agents, other organic silicon compounds, and organic titanium compounds. These treatment agents may be used alone or in combination. Among them, in particular, inorganic fine powders treated with silicone oils can be used. Furthermore, a hydrophobized inorganic fine powder that has been treated with a silicone oil simultaneously or after hydrophobization treatment with a coupling agent can maintain a high frictional electrification amount of toner particles even under a high-moisture environment and can reduce selective development.

Next, methods of producing the toner particles will be described. The toner participles used in the present invention can be produced by any of pulverization, suspension polymerization, and emulsion aggregation. In particular, a method of producing toner particles in an aqueous dispersion medium can give toner particles excellent in development stability even if a large amount of wax components are added. Examples of the method of producing toner particles in an aqueous dispersion medium include an emulsion aggregation method in which an emulsion composed of toner essential components is aggregated in an aqueous dispersion medium; a suspension granulation method in which toner essential components are dissolved in an organic solvent, followed by granulation in an aqueous dispersion medium, and then the organic solvent is volatilized; a suspension or emulsion polymerization method in which a polymerizable monomer dissolving toner essential components is directly granulated in an aqueous dispersion medium and then polymerized; a method including a step of providing outer layers to toner particles through seed polymerization; and microcapsulation methods represented by interfacial polycondensation and drying in liquid.

The toner particles of the present invention can be particularly produced by suspension polymerization. In the suspension polymerization, a polymerizable monomer composition is prepared by uniformly dissolving or dispersing a wax and a coloring agent (and, optionally, a polymerization initiator, a cross-linking agent, a charge control agent, and other excipients) in a polymerizable monomer. This polymerizable monomer composition is added to an aqueous dispersion medium containing a dispersion stabilizer and is dispersed therein using an appropriate stirrer for a polymerization reaction to obtain toner particles having a desired particle diameter. After the completion of the polymerization, the toner particles are subjected to filtration, washing, and drying by known methods and are optionally mixed with a fluidity-improving agent so that the agent adhere to the surfaces of the particles to obtain a toner.

The dispersing agent used in the preparation of the aqueous dispersion medium may be a known inorganic or organic dispersing agent. Specific examples of the inorganic dispersing agent include tricalcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica, and alumina. Examples of the organic dispersing agent include poly(vinyl alcohol), gelatin, methyl cellulose, methyl hydroxypropyl cellulose, ethyl cellulose, a sodium salt of carboxymethyl cellulose, and starch.

In addition, commercially available nonionic, anionic, and cationic surfactants can be used, and examples thereof include sodium dodecylbenzenesulfonate, sodium dodecyl sulfate, sodium tetradecyl sulfate, sodium pentadecyl sulfate, sodium octyl sulfate, sodium oleate, sodium laurate, potassium stearate, and calcium oleate.

The dispersing agent used in the preparation of the aqueous dispersion medium that will be used for the toner of the present invention can be a poor water-soluble inorganic dispersing agent, in particular, an acid-soluble, poor water-soluble, inorganic dispersing agent. Furthermore, in the present invention, when the aqueous dispersion medium is prepared using a poor water-soluble inorganic dispersing agent, the amount of the dispersing agent used can be 0.2 parts by mass or more and 2.0 parts by mass or less based on 100 parts by mass of the polymerizable monomer.

In addition, in the present invention, the aqueous dispersion medium can be prepared using water in an amount of 300 parts by mass or more and 3000 parts by mass or less based on 100 parts by mass of the polymerizable monomer composition.

In the present invention, when an aqueous dispersion medium in which the above-mentioned poor water-soluble inorganic dispersing agent is dispersed is prepared, a commercially available dispersing agent may be directly used. Furthermore, in order to obtain dispersing agent particles having a fine and uniform particle size, an aqueous dispersion medium may be prepared by generating the above-mentioned poor water-soluble inorganic dispersing agent in a liquid medium such as water with high-speed stirring. For example, in the case of using tricalcium phosphate as the dispersing agent, a desired dispersing agent can be obtained by forming fine particles of tricalcium phosphate through mixing an aqueous solution of sodium phosphate and an aqueous solution of calcium chloride with high-speed stirring.

The toner of the present invention can be used as a two-component developer by using together with a carrier. The carrier that is used in the two-component developing method may be a known one, and specifically, particles having average particle diameter of 20 to 300 μm made of iron, nickel, cobalt, manganese, chromium, a metal such as a rare-earth element, or an alloy or oxide thereof are used. In addition, a magnetic substance dispersing carrier in which the magnetic substance is dispersed in a resin or a low specific gravity carrier in which porous iron oxide is filled with a resin can be also used. Furthermore, these carrier particles can be attached or covered with a resin such as a styrene resin, an acrylic resin, a silicone resin, a fluorine resin, or a polyester resin on the surfaces thereof.

The methods of measuring physical properties according to the present invention will be described below. Measurements of peak top temperature and peak width at half height of maximum endothermic peak of wax The peak top temperatures and the peak width at half height of maximum endothermic peak of a wax are measured in accordance with ASTM D3418-82 using a differential scanning calorimeter, "Q1000" (manufactured by TA Instruments Japan Inc.). The temperature of the detector of the apparatus is corrected using the melting points of indium and zinc, and the heat quantity is corrected using the melting heat of indium. Specifically, about 5 mg of a wax is precisely weighed and is put in an aluminum pan. As a reference, an empty aluminum pan is used. The measurement is conducted by increasing the temperature of each pan at a heating rate of 10° C./min in a measurement temperature range of 30 to 200° C.

In the measurement, the temperature is increased to 200° C. once and is then decreased to 30° C. Subsequently, the temperature is increased again. The peak top temperature in the maximum endothermic peak of an endothermic curve in the temperature range of 30 to 200° C. of this second temperature-increasing process is defined as the peak top temperature of the maximum endothermic peak of the wax of the present invention.

Furthermore, the temperature width of the maximum endothermic peak at a half height determined by drawing a perpendicular line from the peak top of the maximum endothermic peak to the base line of the endothermic curve is defined as the peak width at half height of the wax of the present invention.

Gel Permeation Chromatography (GPC) of Wax

Molecular weight distribution of a wax is measured as follows by gel permeation chromatography (GPC).

Special grade 2,6-di-t-butyl-4-methylphenol (BHT) is added to o-dichlorobenzene for gel chromatography at a concentration of 0.10% (mass/volume), followed by dissolution at room temperature. A wax and this o-dichlorobenzene containing BHT are placed in a sample bottle and are heated on a hot-plate that has been set to a temperature of 150° C. to dissolve the wax. After dissolving of the wax, the solution is put in a filter unit heated in advance, and the filter unit is set to the main body. The solution passed through the filter unit is used as a GPC sample. The concentration of the sample solution is adjusted to about 0.15% by mass. This sample solution is subjected to measurement under the following conditions:

Apparatus: HLC-8121GPC/HT (manufactured by Tosoh Corporation)

Detector: RI for high temperature

Column: TSK gel GMHHR-H HT×2 (manufactured by Tosoh Corporation)

Temperature: 135.0° C.

Solvent: o-dichlorobenzene for gel chromatography (containing 0.10% (mass/volume) of BHT)

Flow rate: 1.0 mL/min

Injection volume: 0.4 mL

In the calculation of the molecular weight of the wax, a molecular weight calibration curve prepared using a standard polystyrene resin (for example, the trade name "TSK standard polystyrene F-850, F-450, F-288, F-128, F-80, F-40, F-20, F-10, F-4, F-2, F-1, A-5000, A-2500, A-1000, A-500" manufactured by Tosoh Corporation) is used. Then, the molecular weight is calculated by polystyrene conversion of the obtained measurement result with a conversion expression derived from the Mark-Houwink viscosity equation.

Measurement of Weight-Average Particle Diameter (D4) of Toner

The weight-average particle diameter (D4) of a toner is calculated as follows. As the measurement apparatus, a precision particle size distribution measurement apparatus based on a pore electrical resistance method, "Coulter Counter Multisizer 3" (registered trademark, manufactured by Beckman Coulter, Inc.) is used. The setting of measurement conditions and the analysis of measurement data are performed with dedicated software "Beckman Coulter Multisizer 3 Version 3.51" (manufactured by Beckman Coulter, Inc.) included in the apparatus. The measurement is performed with the number of effective measurement channels set to 25000.

As the electrolyte solution used in the measurement, those prepared by dissolving special grade sodium chloride in ion-exchanged water at a concentration of about 1% by mass, for example, "ISCION II" (manufactured by Beckman Coulter, Inc.), can be used.

The dedicated software is set as described below prior to the measurement and the analysis.

In the changing screen of standard measurement method (SOM) of the dedicated software, the total count number of a control mode is set to 50000 particles, the number of measurement is set to once, and a value obtained using "standard particles: 10.0 μm" (manufactured by Beckman Coulter, Inc.) is set as the Kd value. The threshold and the noise level are automatically set by pressing the threshold/noise level measurement button. In addition, the current is set to 1600 μA, the gain is set to 2, and the electrolyte solution is set to an ISOTON II, and a check mark is placed in the aperture tube is flushed after the measurement.

In the setting screen for conversion from pulse to particle diameter of the dedicated software, the bin interval is set to a logarithmic particle diameter, the number of particle diameter bins is set to 256, and the particle diameter range is set to a range of 2 to 60 μm.

The specific measurement method is as follows.

(1) About 200 mL of the electrolyte solution is put in a 250-mL round-bottom glass beaker dedicated for the Multisizer 3. The beaker is set in a sample stand, and the electrolyte solution is stirred with a stirrer rod at 24 r/sec in a counterclockwise direction. Then, the dirt and bubbles in the aperture tube are removed by the "aperture flush" function of the dedicated software.

(2) About 30 mL of the electrolyte solution is put in a 100-mL flat-bottom glass beaker. About 0.3 mL of a diluted solution prepared by diluting a "Contaminon N" (a 10% by mass aqueous solution of a precision-measuring-device-washing neutral detergent composed of a nonionic surfactant, an anionic surfactant, and an organic builder and having a pH of 7, manufactured by Wako Pure Chemical Industries, Ltd.) with ion-exchanged water by about three mass fold is added as a dispersing agent to the beaker.

(3) An ultrasonic dispersing device having an electrical output of 120 W, "Ultrasonic Dispersion System Tetora 150" (manufactured by Nikkaki Bios Co., Ltd.), in which two oscillators each having an oscillatory frequency of 50 kHz are built-in with a phase displacement of 180° from each other, is prepared. A predetermined amount of ion-exchanged water is put in the water tank of the ultrasonic dispersing device, and about 2 mL of the Contaminon N is then added to the water tank.

(4) The beaker in the above (2) is set in the beaker fixing hole of the ultrasonic dispersing device, and the ultrasonic dispersing device is operated. Then, the height position of the beaker is adjusted so that the resonant state of the liquid surface of the electrolyte solution in the beaker becomes the maximum.

(5) About 10 mg of a toner is gradually added to the electrolyte solution in the beaker in the above (4) while irradiating the electrolyte solution with the ultrasonic wave to disperse the toner. The ultrasonic dispersion treatment is further continued for 60 seconds. In the ultrasonic dispersion, the temperature of water in the tank is appropriately adjusted to 10° C. or more and 40° C. or less.

(6) The electrolyte solution in the above (5) in which the toner has been dispersed is dropped with a pipette in the round-bottom beaker in the above (1) set in the sample stand until the concentration of the toner becomes about 5%. Then, measurement is performed until 50000 particles are counted.

(7) The measurement data is analyzed with the dedicated software included with the apparatus, and the weight-average particle diameter (D4) is calculated. Note that an "average diameter" on the analysis/volume statistics (arithmetic average) screen, when the dedicated software is set to show a graph/% by volume, is the weight-average particle diameter (D4).

The toner of the present invention can be used in image forming apparatuses as shown in FIG. 1. FIG. 1 shows a tandem-type full-color printer in which four image forming portions Pa, Pb, Pc, and Pd are arranged in a linear section of the intermediate transfer belt 7. In the image forming portion Pa, a yellow toner image is formed on a photosensitive drum 1*a* and then is primarily transferred onto the rotating endless intermediate transfer belt 7. In the image forming portion Pb, a magenta toner image is formed on a photosensitive drum 1*b* and then is primarily transferred over the yellow toner image on the intermediate transfer belt 7. In the image forming portions Pc and Pd, a cyan toner image and black toner image are formed on the photosensitive drums 1*c* and 1*d*, respectively, and similarly are primarily transferred sequentially over the images on the intermediate transfer belt 7. The four-color toner image primarily transferred on the intermediate transfer belt 7 is conveyed to a second transfer portion T2 and is collectively transferred onto a recording material P. The recording material P on which the four-color toner image is secondarily transferred at the second transfer portion T2 is applied with heat and pressure by a fixing device 25 so that the toner image is fixed thereon and is ejected to the outside. In the fixing device 25, a pressure roller 25*b* is abutted onto a heating roller 25*a* provided with a lamp heater 25*c*, and the toner image supported on the recording medium P is fixed on the surface of the recording medium by heat and pressure. The image forming portions Pa, Pb, Pc, and Pd are almost the same except that the colors of toners used in the attached developing devices 4*a*, 4*b*, 4*c*, and 4*d* are yellow, magenta, cyan, and black, respectively. The intermediate transfer belt 7 is hung over rotators such as a drive roller 13, a back-up roller 10, and a tension roller 12 and is supported by them. The intermediate transfer belt 7 is driven by a driving motor M3 to rotate in the direction shown by the arrow R2. Note that, in FIG. 1, reference numerals 2*a* to 2*d* denote charge rollers, reference numerals 3*a* to 3*d* denote laser light sources, reference numerals 5*a* to 5*d* denote first transfer rollers, reference numerals 6*a* to 6*d* denote cleaning units, a reference numeral 11 denotes a second transfer roller, a reference numeral 19 denotes a cleaning apparatus, and a reference numeral 19*b* denotes a cleaning blade.

Figure 2:
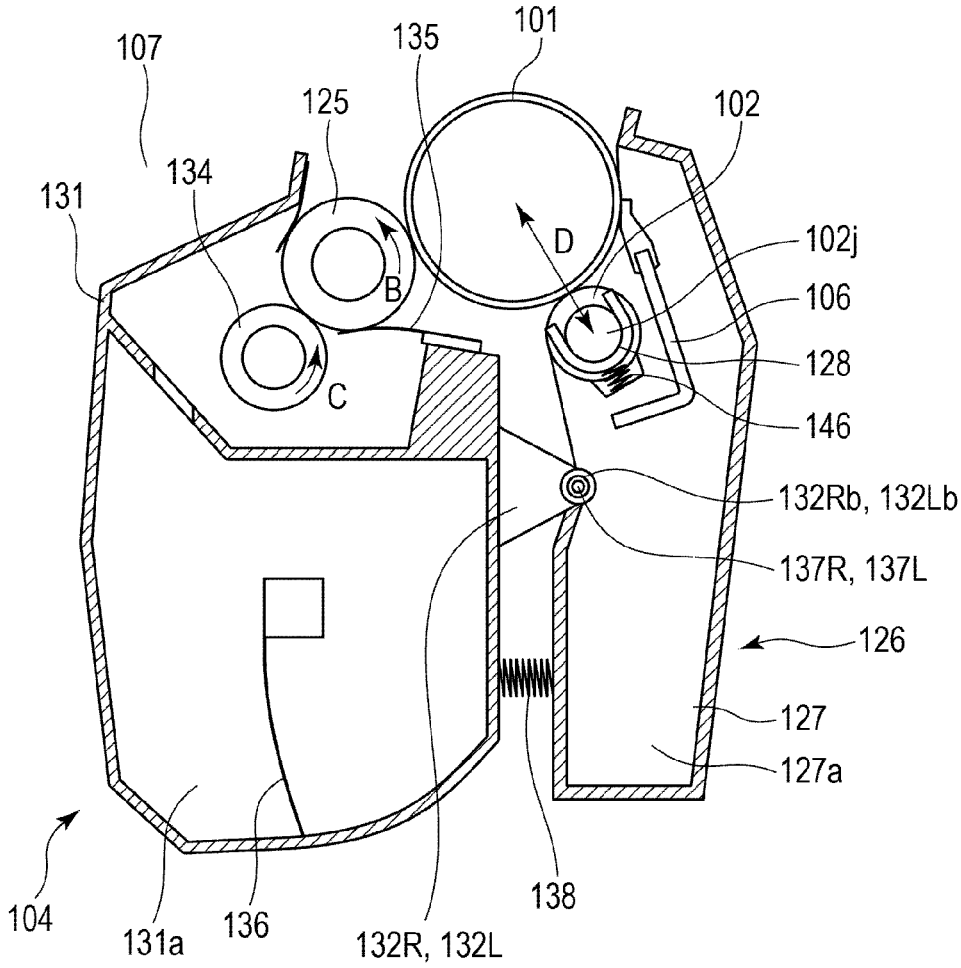
FIG. 2 is a cross-sectional view schematically illustrating a process cartridge.
Figure 3:
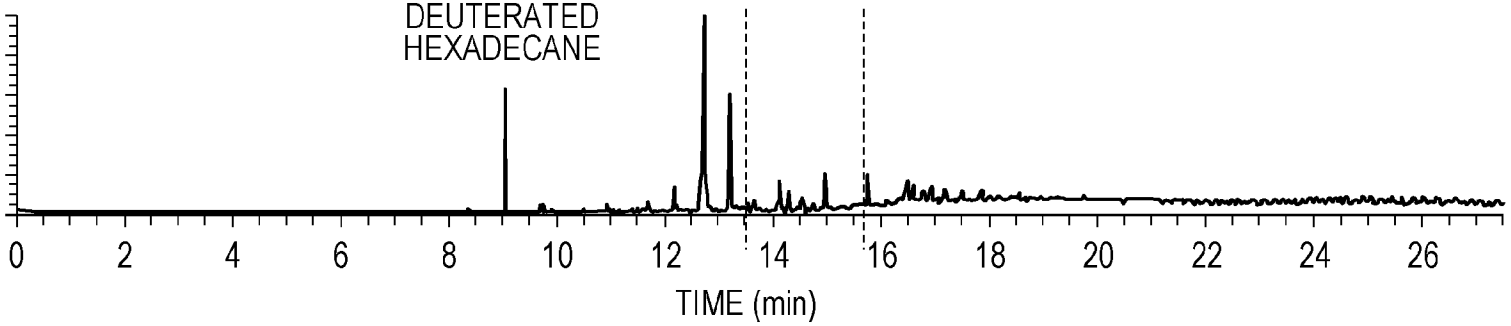
FIG. 3 is a diagram showing the result of GC/MS analysis of components volatilized by heating wax No. 8 used in an example of the present invention at 200° C. for 10 minutes.
Figure 4:
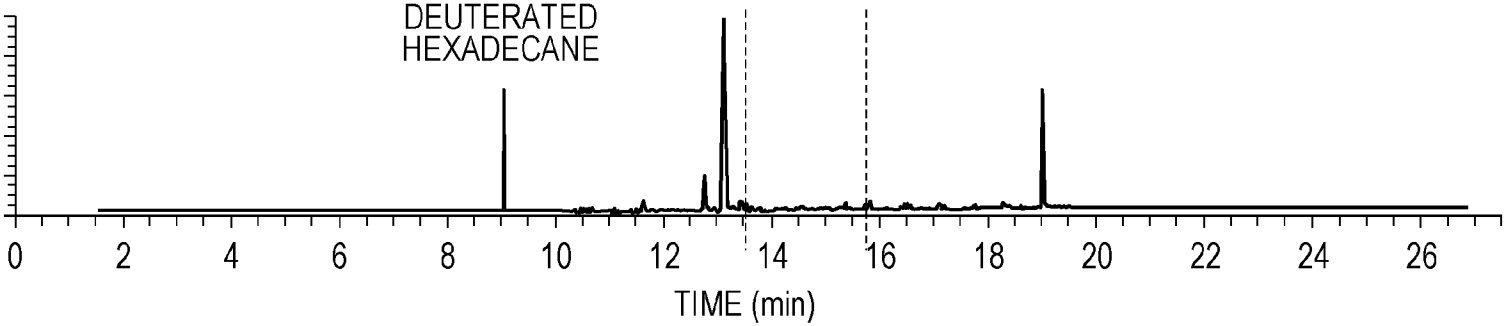
FIG. 4 is a diagram showing the result of GC/MS analysis of components volatilized by heating wax No. 17 used in a comparative example of the present invention at 200° C. for 10 minutes.

FIG. 2 shows an example of a process cartridge in which the mechanism excluding the laser source 3*a* from the image forming portion Pa shown in FIG. 1 is unified. The process cartridge 107 is composed of a drum unit 126 including a photosensitive drum 101, a charging roller 102, and a cleaning member 106 and a developing unit 104 including a developing member. The photosensitive drum 101 is rotatably attached to a cleaning frame 127 of the drum unit 126 via bearings (not shown). The charging roller 102 and the cleaning member 106 are disposed on the circumference of the photosensitive drum 101. The residual toner that has been removed from the surface of the photosensitive drum 101 with the cleaning member 106 falls into a removed toner chamber 127*a*. The photosensitive drum 101 is rotated according to image forming operation by transmitting the driving power of a drive motor (not shown) serving as a driving source to the drum unit 126. The charging roller bearings 128 is attached to the cleaning frame 127 so as to be movable in the direction shown by the allow D. The charging roller 102 is attached to the charging roller bearings 128 so that the shaft 102*j* is rotatable. The charging roller bearing 128 is pressed toward the photosensitive drum 101 by the charging roller pressing member 146.

The developing unit 104 serving as a developing device is constituted of a developing roller 125 that rotates in the direction shown by the arrow B by being brought into contact with the photosensitive drum 101 and a developing frame 131. The developing roller 125 is rotatably supported by the developing frame 131 via bearing members 132 attached to both sides of the developing frame 131. In the vicinity of the developing roller 125, a toner supplying roller 134 that is rotated in the direction shown by the arrow C by being in contact with the developing roller 125 and a developing blade 135 that regulates the toner layer on the developing roller 125 are arranged. Furthermore, in a toner receiving portion 131*a* of the developing frame 131, a toner conveying member 136 for stirring the toner received and conveying the toner to the toner-supplying roller 134 is disposed. The developing unit 104 is rotatably connected to the drum unit 126 with the shafts 137R and 137L fitting to the holes 132Rb and 132Lb disposed in the bearing members 132R and 132L as the rotation center. During the image formation by the process cartridge 107, the developing unit 104 is biased with a pressure spring 138 and thereby rotates around the shafts 137R and 137L serving as the rotation center, and the developing roller 125 abuts to the photosensitive roller 101.

EXAMPLES

The present invention will be described by examples below, but is not limited these examples. Note that the number of part(s) in the examples refers to part(s) by mass. Production of Wax Nos. 1 and 7

1,4-Butanediol and behenic acid were subjected to a dehydration condensation reaction to synthesize butanediol dibehenate. Subsequently, conditions of a temperature of 180° C. and a pressure of 2 Pa were maintained for 60 minutes using a wiped film evaporator, and then the temperature was stepwise increased to 185° C., 190° C., and 195° C., and distillation was conducted at each temperature for 60 minutes to remove 15% by mass of light distillate. Then, 5% by mass of distillation residues were removed by reducing the pressure to 1 Pa and increasing the temperature to 250° C. to obtain a distilled wax fraction at a yield of 80% by mass. From the distilled wax fraction, 5% by mass of light distillate and 5% by mass of distillation residues were removed at a temperature of 195° C. and a pressure of 0.2 Pa using a molecular distillator.

Furthermore, after cooling, washing with water, dehydration, and then drying, wax No. 1 (butanediol dibehenate) was obtained. Similarly, wax No. 7 (butanediol dibehenate) was obtained as in above except that the temperature for molecular distillation was 180° C.

Production of Wax No. 2

A carnauba wax as a raw material was maintained at a temperature of 180° C. and a pressure of 2 Pa for 60 minutes, and then the temperature was stepwise increased to 185° C., 190° C., and 195° C., and distillation was conducted at each temperature for 60 minutes to remove 15% by mass of light distillate. Then, 5% by mass of distillation residues were removed by reducing the pressure to 1 Pa and increasing the temperature to 250° C. to obtain a distilled wax fraction at a yield of 80% by mass. From the distilled wax fraction, 5% by mass of light distillate and 5% by mass of distillation residues were removed at a temperature of 195° C. and a pressure of 0.2 Pa using a molecular distillator.

Furthermore, after cooling, washing with water, dehydration, and then drying, wax No. 2 (carnauba wax) was obtained.

Production of Wax Nos. 3 and 4

Polyglycerin and behenic acid were subjected to a dehydration condensation reaction to synthesize polyglycerin behenic acid ester. Subsequently, conditions of a temperature of 180° C. and a pressure of 2 Pa were maintained for 60 minutes, and then the temperature was stepwise increased to 185° C., 190° C., and 195° C., and distillation was conducted at each temperature for 60 minutes to remove 15% by mass of light distillate. Then, 5% by mass of distillation residues were removed by reducing the pressure to 1 Pa and increasing the temperature to 250° C. to obtain a distilled wax fraction at a yield of 80% by mass. From the distilled wax fraction, 5% by mass of light distillate and 5% by mass of distillation residues were removed at a temperature of 195° C. and a pressure of 0.2 Pa using a molecular distillator.

Furthermore, after cooling, washing with water, dehydration, and then drying, wax No. 3 (polyglycerin behenic acid ester) was obtained. Similarly, wax No. 4 (polyglycerin behenic acid ester) was obtained as in above except that the temperature for molecular distillation was 180° C.

Production of Wax Nos. 5 and 6

Behenyl alcohol and sebacic acid were subjected to a dehydration condensation reaction to synthesize dibehenyl sebacate. Subsequently, conditions of a temperature of 180° C. and a pressure of 2 Pa were maintained for 60 minutes, and then the temperature was stepwise increased to 185° C., 190° C., and 195° C., and distillation was conducted at each temperature for 60 minutes to remove 15% by mass of light distillate. Then, 5% by mass of distillation residues were removed by reducing the pressure to 1 Pa and increasing the temperature to 250° C. to obtain a distilled wax fraction at a yield of 80% by mass. From the distilled wax fraction, 5% by mass of light distillate and 5% by mass of distillation residues were removed at a temperature of 195° C. and a pressure of 0.2 Pa using a molecular distillator.

Furthermore, after cooling, washing with water, dehydration, and then drying, wax No. 5 (dibehenyl sebacate) was obtained. Similarly, wax No. 6 (dibehenyl sebacate) was obtained as in above except that the temperature for molecular distillation was 180° C.

Production of Wax Nos. 8 to 13

Behenyl alcohol and stearic acid were subjected to a dehydration condensation reaction to synthesize dibehenyl stearate. Subsequently, conditions of a temperature of 180° C. and a pressure of 2 Pa were maintained for 60 minutes, and then the temperature was stepwise increased to 185° C., 190° C., and 195° C., and distillation was conducted at each temperature for 60 minutes to remove 15% by mass of light distillate. Then, 5% by mass of distillation residues were removed by reducing the pressure to 1 Pa and increasing the temperature to 250° C. to obtain a distilled wax fraction at a yield of 80% by mass. From the distilled wax fraction, 5% by mass of light distillate and 5% by mass of distillation residues were removed at a temperature of 195° C. and a pressure of 0.2 Pa using a molecular distillator.

Furthermore, after cooling, washing with water, dehydration, and then drying, wax No. 8 (behenyl stearate) was obtained. Similarly, wax No. 9 (behenyl stearate) was obtained as in above except that the temperature for molecular distillation was 180° C. Furthermore, similarly, wax Nos. 10 to 12 (all are behenyl stearate) were obtained by decreasing the temperature for molecular distillation to 150° C. by 10° C.

Wax No. 13 (behenyl stearate) was obtained as in the production of wax No. 12 except that the initial fraction components in the wiped film distillation were removed in an amount of 10% by mass of the raw material.

Production of Wax Nos. 14 and 18

Stearyl alcohol and behenic acid were subjected to a dehydration condensation reaction to synthesize stearyl behenate. Subsequently, conditions of a temperature of 180° C. and a pressure of 2 Pa were maintained for 60 minutes, and then the temperature was stepwise increased to 185° C., 190° C., and 195° C., and distillation was conducted at each temperature for 60 minutes to remove 15% by mass of light distillate. Then, 5% by mass of distillation residues were removed by reducing the pressure to 1 Pa and increasing the temperature to 250° C. to obtain a distilled wax fraction at a yield of 80% by mass. From the distilled wax fraction, 5% by mass of light distillate and 5% by mass of distillation residues were removed at a temperature of 195° C. and a pressure of 0.2 Pa using a molecular distillator.

Furthermore, after cooling, washing with water, dehydration, and then drying, wax No. 14 (stearyl behenate) was obtained. Similarly, wax No. 18 (stearyl behenate) was obtained as in the production of wax No. 14 except that the initial fraction components in the wiped film distillation were removed in an amount of 10% by mass of the raw material.

Production of Wax Nos. 15 to 17 and 19

Stearyl alcohol and stearic acid were subjected to a dehydration condensation reaction to synthesize stearyl stearate. Subsequently, conditions of a temperature of 180° C. and a pressure of 2 Pa were maintained for 60 minutes, and then the temperature was stepwise increased to 185° C., 190° C., and 195° C., and distillation was conducted at each temperature for 60 minutes to remove 15% by mass of light distillate. Then, 5% by mass of distillation residues were removed by reducing the pressure to 1 Pa and increasing the temperature to 250° C. to obtain a distilled wax fraction at a yield of 80% by mass. From the distilled wax fraction, 5% by mass of light distillate and 5% by mass of distillation residues were removed at a temperature of 195° C. and a pressure of 0.2 Pa using a molecular distillator.

Furthermore, after cooling, washing with water, dehydration, and then drying, wax No. 15 (stearyl stearate) was obtained. Similarly, wax No. 16 (stearyl stearate) was obtained as in above except that the temperature for molecular distillation was 180° C. Furthermore, similarly, wax No. 17 (stearyl stearate) was obtained by reducing the temperature for molecular distillation to 160° C.

Furthermore, wax No. 19 (stearyl stearate) was obtained as in the production of wax No. 17 except that the initial fraction components in the wiped film distillation were removed in an amount of 10% by mass of the raw material.

Physical properties of wax Nos. 1 to 19 are shown in Table 1.

Example 1

Preparation of Aqueous Dispersion Medium

A mixture of
water: 350.0 parts, and
trisodium phosphate: 15.0 parts
was maintained at 60° C. with stirring using a high-speed stirring apparatus, TK-type homomixer, at 12000 r/min. Then, 9 parts by mass of calcium chloride was added thereto to prepare an aqueous dispersion medium containing fine poor water-soluble stabilizing agent $Ca_3(PO_4)_2$.

Dispersion Process

A mixture of
styrene: 30.0 parts,
C.I. Pigment Blue 15:3: 5.0 parts, and
negative charge control agent (aluminum compound of 3,5-di-tert-butyl salicylic acid): 1.0 part
was dispersed at ordinary temperature for 5 hours with an attritor to obtain polymerizable monomer composition 1.

Dissolution Process

A mixture of
styrene: 35.0 parts,
n-butyl acrylate: 35.0 parts,
polar resin A (polyester resin being a polycondensate of propylene oxide-modified bisphenol A and terephthalic acid, Mw: 9500, Tg: 74° C., acid value Av: 9 mg KOH/g, hydroxyl value OHv: 25 mg KOH/g): 5.0 parts, and
polar resin B (styrene-2-ethylhexyl acrylate copolymer containing 5% 2-acrylamide-2-methylpropane sulfonic acid, Tg: 81° C.): 1.0 part
was put in a temperature-controllable mixing container and was heated to 60° C. and stirred for 5 hours to obtain polymerizable monomer composition 2. While maintaining the polymerizable monomer composition 2 at 60° C., the polymerizable monomer composition 1 was added thereto. Then, wax No. 1 (butanediol dibehenate, the physical properties are shown in Table 1): 15.0 parts, and
divinylbenzene: 0.3 parts
were added to the resulting mixture, followed by further stirring for 1 hour to prepare polymerizable monomer composition 3.

Granulation/Polymerization Process

The obtained polymerizable monomer composition 3 was added to the above-mentioned aqueous dispersion medium. To the resulting aqueous dispersion medium, 8.0 parts by mass of Perbutyl PV (10-hour half-life temperature: 54.6° C. (manufactured by NOF Corp.)) was added as a polymerization initiator, and granulation was performed by maintaining the rotating speed of the stirring apparatus at 12000 rpm for 30 minutes. Then, the high-speed stirring apparatus was changed to a propeller type stirring apparatus, and a reaction was carried out by gently stirring at an inner temperature of 70° C. for 5 hours. Subsequently, the temperature inside the container was increased to 80° C. and was maintained at this temperature for 5 hours, followed by cooling to obtain a polymer fine particle dispersion. Washing/solid-liquid separation/drying process/external addition process The obtained polymer fine particle dispersion was adjusted to a pH of 1.4 with dilute hydrochloric acid, and a stabilizing agent, $Ca_3(PO_4)_2$, was dissolved therein. After filtration and washing, and then vacuum dehydration at 40° C., coarse particles were removed using a sieve with an aperture of 150 μm to adjust the particle size distribution to obtain cyan toner particles. To 100 parts of the obtained cyan toner particles, 2.0 parts of hydrophobic silica (100 parts of silica treated with 10 parts of silicone oil, average primary particle diameter: 13 nm) having a specific surface area measured by a BET method of 200 $m^2/g$ was externally added with stirring for 10 minutes in a Henschel mixer to obtain cyan toner No. 1 (weight-average particle diameter (D4): 6.5 μm). The obtained cyan toner No. 1 was evaluated for the following (1) to (5). The evaluation results are shown in Table 2.

In the image evaluation, a commercially available laser printer LBP-9500C (manufactured by CANON KABUSHIKI KAISHA) such as that shown in FIG. 1 provided with the following remodeling was used. The remodeling of this evaluation apparatus are as follows.

(1) The process speed was changed to 360 mm/sec by changing the gear and software of the evaluation apparatus main body.

(2) Product toners were extracted from all cartridges of yellow, magenta, cyan, and black, and the cartridges were refilled with toners to be evaluated. That is, the product toner is extracted from a commercially available cyan cartridge such as that shown in FIG. 2, and the inside of the cartridge is cleaned by air blow. Then, the cartridge was refilled with 280 g of a toner to be evaluated and was used for evaluation.

(3) The fixing device was modified by the software so that the heating temperature can be controlled within 200±20° C.

The process cartridge filled with cyan toner No. 1 was left to stand under a high-temperature and high-humidity (32.5° C., 80% RH) environment for 24 hours. Then, an image with a printing ratio of 5% for each color (full color printing ratio: 20%) was output on 200000 sheets of A4 Canon Color Laser Copier (81.4 $g/m^2$), and the images were evaluated. During the test, the evaluation was continued by exchanging the cartridge in which the toner was consumed with a new one filled with cyan toner No. 1 prepared by the same manner. After output onto 200000 sheets, solid concentration uniformity, gloss uniformity, half-tone concentration uniformity, image contamination, and feeding stability were evaluated. The inside contamination was evaluated mainly in the image contamination and feeding stability.

(1) Evaluation of Solid Concentration Uniformity

A solid black image was output on one sheet of Canon Color Laser Copier (A3 size, 81.4 $g/m^2$) immediately after breaking the seal. The relative image concentration of the solid black image portion, when the image concentration of the white portion is defined as 0.00, was measured using "Macbeth Reflection densitometer RD-918" (manufactured by GretagMacbeth Corp.) in accordance with the instruction manual included with the apparatus. The concentrations at arbitrary ten points of the solid black image portion were measured, and difference between the maximum concentration and the minimum concentration was evaluated by the following criteria:

A: image concentration difference of less than 0.05,

B: image concentration difference of 0.05 or more and less than 0.10,

C: image concentration difference of 0.10 or more and less than 0.15, and

D: image concentration difference of 0.15 or more.

(2) Evaluation of Gloss Uniformity

A solid black image was output at the heavy paper mode (process speed: 90 mm/sec) on one sheet of HP Color Laser Photo Paper, Glossy (Letter size, 220 g/m$^2$) immediately after breaking the seal. Arbitrary ten points of the solid black image portion were subjected to 75° gloss measurement, and the gloss uniformity was evaluated from the difference between the maximum value and the minimum value of glossiness by the following criteria. The gloss was measured using black glass having a glossiness of 96.9 as a reference surface with PG-3D (incident angle θ: 75°) manufactured by Nippon Denshoku Industries Co., Ltd. The criteria are as follows:

A: gloss difference of less than 5.0,

B: gloss difference of 5.0 or more and less than 10.0,

C: gloss difference of 10.0 or more and less than 15.0, and

D: gloss difference of 15.0 or more.

(3) Evaluation of Half-Tone Concentration Uniformity

A half-tone image was output on one sheet of Canon Color Laser Copier (A3 size, 81.4 g/m$^2$) immediately after breaking the seal. The obtained half-tone image was visually observed and was evaluated by the following criteria:

A: the half-tone image is uniform,

B: a faint vertical line that can be erased by image processing is observed, and C: a clear vertical line that cannot be erased by image processing is observed.

(4) Evaluation of Image Contamination

A solid white image was output on 100 sheets of Canon Color Laser Copier (A3 size, 81.4 g/m$^2$) immediately after breaking the seal. The obtained solid white image was visually observed and was evaluated by the following criteria:

A: no problems are visually observed,

B: no contamination is confirmed on the image surface by visual observation, but slight contamination due to the cyan toner is observed on the not-printing circumferential surfaces of the sheets (so-called sheet edge portion) when 100 sheets of the output are stacked, and C: contamination is confirmed on the image surface by visual evaluation.

(5) Evaluation of Feeding Stability

A solid white image was output on both sides of 100 sheets of Canon CS-680 (A3 size, 68.0 g/m$^2$) left to stand under a high-temperature and high-humidity (32.5° C., 80% RH) environment for 48 hours, and the feeding state was visually observed and was evaluated by the following criteria:

A: 100 sheets was fed without any problem, and

D: paper jam occurred two or more times during the image output on 100 sheets.

(6) Evaluation of Inside Contamination

The obtained toner was subjected to a durability test of 200000 sheets using a commercially available laser beam printer LBP 9500C (manufactured by CANON KABUSHIKI KAISHA) provided with the following remodeling: the process speed of the plain paper mode was changed to 360 mm/sec, the process speed of the heavy paper mode was changed to 90 mm/sec, and the fixing temperature was set to 200° C. An original chart formed with a printing ratio of 5% for each color (full color printing ratio: 20%) was used as the chart of durability evaluation. A cyan cartridge in which all stations for yellow, magenta, cyan, and black were refilled with the obtained toners was mounted on the printer, and printing was continued by exchanging the cartridge in which the toner was consumed with a new one.

The durability test was performed under an ordinary-temperature and ordinary-humidity (temperature: 23° C., humidity: 50% RH) environment through a printing test of 200000 sheets in total by repeating feeding 8000 sheets of A4 size paper having a basis weight of 68 g/m$^2$ at the plain paper mode and feeding 2000 sheets of Letter size paper having a basis weight of 220 g/m$^2$ at the heavy paper mode.

After the durability test, the contamination state around the fixing device was visually observed and was evaluated by the following criteria:

A: no distinct contamination is observed in the vicinity of the fixing device,

B: slight contamination is observed in the vicinity of the fixing device,

C: contamination spreading to a fixing guiding member is clearly observed, and

D: a high level of contamination is distinctly observed in the vicinity of the fixing device.

Examples 2 to 10 and Comparative Examples 1 to 9

Cyan toner Nos. 2 to 17, 20, and 21 were prepared as in Example 1 except that different types of waxes were used. The obtained toners were evaluated as in cyan toner No. 1, and the evaluation results are shown in Table 2.

Example 11

Preparation of Resin Particle Dispersion 1

The following materials:

styrene: 90.0 parts, n-butyl acrylate: 20.0 parts, acrylic acid: 3.0 parts, dodecanethiol: 6.0 parts, and carbon tetrabromide: 1.0 part were mixed and dissolved. The resulting mixture was dispersed in a solution prepared by dissolving 1.5 parts of a nonionic surfactant (Nonipol 400, manufactured by Sanyo Chemical Industries, Ltd.) and 2.5 parts of an anionic surfactant (Neogen S.C., manufactured by Daiich Kogyo Seiyaku Co., Ltd.) in 140.0 parts of ion-exchanged water in a flask, followed by emulsification. While gently mixing the emulsion for 10 minutes, 10.0 parts of ion-exchanged water dissolving 1 part of ammonium persulfate was added to this emulsion, and nitrogen substitution was carried out. Then, the content in the flask was heated to 70° C. in an oil bath with stirring, and the emulsion polymerization was continued at this state for 5 hours. Thus, resin particle dispersion 1 in which resin particles having an average particle diameter of 0.17 μm, a glass transition point of 57° C., and a weight-average molecular weight (Mw) of 11000 were dispersed was prepared.

Preparation of Resin Particle Dispersion 2

The following materials:

styrene: 75.0 parts, n-butyl acrylate: 25.0 parts, and acrylic acid: 2.0 parts, were mixed and dissolved. The resulting mixture was dispersed in a solution prepared by dissolving 1.5 parts of a nonionic surfactant (Nonipol 400, manufactured by Sanyo Chemical Industries, Ltd.) and 3.0 parts of an anionic surfactant (Neogen S.C., manufactured by Daiich Kogyo Seiyaku Co., Ltd.) in 140.0 parts of ion-exchanged water in a flask, followed by emulsification. While gently mixing the emulsion for 10 minutes, 10.0 parts of ion-exchanged water dissolving 0.8 parts of ammonium persulfate was added to this emulsion, and nitrogen substitution was carried out. Then, the content in the flask was heated to 70° C. in an oil bath with stirring, and the emulsion polymerization was continued at this state for 5 hours. Thus, resin particle dispersion 2 in which resin particles having an average particle diameter of 0.1 μm, a glass transition point of 61° C., and a weight-average molecular weight (Mw) of 550000 were dispersed was prepared.

Preparation of Mold Release Agent Particle Dispersion

The following materials:

wax No. 1: 50.0 parts, anionic surfactant (Neogen S.C., manufactured by Daiich Kogyo Seiyaku Co., Ltd.): 5.0 parts, and ion-exchanged water: 200.0 parts were heated to 95° C. and were subjected to dispersion treatment with a homogenizer (Ultra Turrax T50, manufactured by IKA Japan K.K.) and then with a pressure discharge homogenizer to prepare a mold release agent particle dispersion in which a mold release agent having an average particle diameter of 0.5 μm were dispersed.

Preparation of Coloring Agent Particle Dispersion 1

The following materials:

C.I. Pigment Blue 15:3: 20.0 parts, anionic surfactant (Neogen S.C., manufactured by Daiich Kogyo Seiyaku Co., Ltd.): 2.0 parts, and ion-exchanged water: 78.0 parts were mixed and dispersed using a sand grinder mill. The particle size distribution of this coloring agent particle dispersion 1 was measured using a particle size measuring apparatus (LA-700, manufactured by Horiba, Ltd.) to confirm that the average particle diameter of the coloring agent particles contained therein was 0.2 μm and that no coarse particles larger than 1 μm were observed.

Preparation of Charge Control Agent Particle Dispersion

The following materials:

metal compound of dialkyl salicylic acid (charge control agent: Bontron E-88, manufactured by Orient Chemical Industries, Ltd.): 20.0 parts, anionic surfactant (Neogen S.C., manufactured by Daiich Kogyo Seiyaku Co., Ltd.): 2.0 parts, and ion-exchanged water: 78.0 parts were mixed and dispersed using a sand grinder mill. The particle size distribution of this charge control agent particle dispersion was measured by a particle size measuring apparatus (LA-700, manufactured by Horiba, Ltd.) to confirm that the average particle diameter of the charge control agent particles contained therein was 0.2 μm and that no coarse particles larger than 1 μm were observed.

Preparation of Mixture Solution

The following materials:

resin particle dispersion 1: 250.0 parts, resin particle dispersion 2: 110.0 parts, coloring agent particle dispersion 1: 50.0 pats, and mold release agent particle dispersion: 80.0 parts were placed in a 1-L separable flask equipped with a stirrer, a cooling tube, and a thermometer and were stirred. This mixture solution was adjusted to a pH of 5.2 with 1 mol/L potassium hydroxide.

Formation of Aggregated Particles

To this mixture solution, 150.0 parts of an aqueous solution of 10% sodium chloride as a flocculant was dropped. The resulting mixture was heated to 57° C. in a heating oil bath with stirring. At this temperature, 3.0 parts of resin particle dispersion 2 and 10.0 parts of charge control agent particle dispersion were added to the mixture. The resulting mixture was kept at 50° C. for 1 hour and was then observed under an optical microscope to confirm that aggregated particles having a weight-average particle diameter of about 5.3 μm were formed.

Fusion Process

Subsequently, 3.0 parts of an anionic surfactant (Neogen S.C., manufactured by Daiich Kogyo Seiyaku Co., Ltd.) was further added to the mixture above. The resulting mixture was put in a stainless steel flask, and the flask was sealed. The mixture was heated to 105° C. while continuing stirring using a magnetic seal and was maintained in that state for 1 hour. Then, after cooling, the reaction product was collected by filtration, sufficiently washed with ion-exchanged water, and then dried to obtain cyan toner particles. To 100 parts of the obtained cyan toner particles, 2.0 parts of hydrophobic silica (100 parts of silica treated with 10 parts of silicone oil, average primary particle diameter: 13 nm) inorganic fine powder having a specific surface area measured by a BET method of 200 $m^2/g$ was externally added with stirring for 10 minutes in a Henschel mixer to obtain cyan toner No. 18 (weight-average particle diameter (D4): 6.4 μm). The evaluation results are shown in Table 2.

Example 12

Production of Binder Resin 1

Styrene-butyl acrylate copolymer A (St/BA=80/20, Tg: 67° C., Mw: 820000) was produced by suspension polymerization using 2,2-bis(4,4-di-t-butylperoxycyclohexyl)propane as a polymerization initiator. Styrene-butyl acrylate copolymer B (St/BA=85/15, Tg: 61° C., Mw: 15800) was produced by solution polymerization using di-t-butyl peroxide as a polymerization initiator. Binder resin 1 was prepared by mixing 30.0 parts by mass of copolymer A with 70 parts by mass of copolymer B in a solution.

The following materials:

binder resin 1: 100.0 parts,

C.I. Pigment Blue 15:3: 6.0 parts, charge control agent, Bontron E-88 (manufactured by Orient Chemical Industries, Ltd.): 1.0 parts, and wax No. 1: 4.0 parts were pre-mixed with a Henschel mixer and then kneaded with a biaxial kneading extruder set to a temperature of 110° C. The obtained kneaded product was cooled and then roughly pulverized with a cutter mill and further finely pulverized with a jet stream pulverizer. The particles were classified with a multi-division classifier utilizing the Coanda effect to obtain cyan toner particles. To 100 parts of the obtained cyan toner particles, 2.0 parts of hydrophobic silica (100 parts of silica treated with 10 parts of silicone oil, average primary particle diameter: 13 nm) inorganic fine powder having a specific surface area measured by a BET method of 200 $m^2/g$ was externally added with stirring for 10 minutes in a Henschel mixer to obtain cyan toner No. 19 (weight-average particle diameter (D4): 6.6 μm). The evaluation results are shown in Table 2.

TABLE 1

| Wax No. | Type of wax | Wax weight-average molecular weight (Mw) | Total amount (A) (ppm) | Total amount (B) (ppm) | Total amount (C) (ppm) | (C)/(B) | (C)/(D) | Total amount (E) (ppm) | Melting point (° C.) | DSC half-width value (° C.) |
|---|---|---|---|---|---|---|---|---|---|---|
| 1 | Diol ester | 900 | 174 | 54 | 60 | 1.1 | 1.0 | 20 | 82 | 3 |
| 2 | Carnauba wax | 2000 | 149 | 20 | 100 | 5.0 | 3.4 | 105 | 82 | 6 |
| 3 | Polyglycerin | 3800 | 290 | 65 | 190 | 2.9 | 5.4 | 490 | 73 | 7 |
| 4 | Polyglycerin | 3900 | 325 | 85 | 200 | 2.4 | 5.0 | 520 | 73 | 8 |
| 5 | Dicarboxylate ester | 930 | 311 | 55 | 96 | 1.7 | 0.6 | 34 | 73 | 5 |
| 6 | Dicarboxylate ester | 930 | 417 | 70 | 99 | 1.4 | 0.4 | 43 | 72 | 5 |
| 7 | Diol ester | 890 | 317 | 114 | 103 | 0.9 | 1.0 | 33 | 80 | 5 |
| 8 | Monoester | 780 | 250 | 67 | 100 | 1.5 | 9.1 | 55 | 70 | 3 |
| 9 | Monoester | 795 | 206 | 84 | 109 | 1.3 | 8.4 | 49 | 69 | 3 |
| 10 | Monoester | 820 | 356 | 136 | 190 | 1.4 | 6.3 | 64 | 68 | 4 |
| 11 | Monoester | 820 | 403 | 160 | 208 | 1.3 | 5.9 | 66 | 68 | 4 |
| 12 | Monoester | 845 | 676 | 197 | 295 | 1.5 | 1.6 | 76 | 67 | 5 |
| 13 | Monoester | 850 | 787 | 200 | 320 | 1.6 | 1.2 | 80 | 67 | 5 |
| 14 | Monoester | 675 | 587 | 220 | 308 | 1.4 | 5.2 | 88 | 70 | 5 |
| 15 | Monoester | 600 | 975 | 380 | 532 | 1.4 | 8.4 | 100 | 65 | 4 |
| 16 | Monoester | 605 | 1009 | 410 | 533 | 1.3 | 8.1 | 105 | 65 | 4 |
| 17 | Monoester | 645 | 1482 | 590 | 826 | 1.4 | 12.5 | 118 | 64 | 5 |
| 18 | Monoester | 722 | 1490 | 605 | 787 | 1.3 | 8.0 | 98 | 68 | 5 |
| 19 | Monoester | 660 | 1600 | 600 | 900 | 1.5 | 9.0 | 120 | 63 | 5 |

TABLE 2

| | Toner | | | | | | | | | |
|---|---|---|---|---|---|---|---|---|---|---|
| | No. | Production method | Weight-average particle diameter D4(μm) | Type of wax | Solid density uniformity | Gloss uniformity | Half-tone density uniformity | Image contamination | Feeding stability | Apparatus inside contamination |
| Example 1 | 1 | Suspension polymerization | 6.5 | 1 | A(0.02) | A(1.5) | A | A | A | A |
| Example 2 | 2 | Suspension polymerization | 6.0 | 2 | A(0.03) | B(5.0) | A | A | A | A |
| Example 3 | 3 | Suspension polymerization | 5.5 | 3 | B(0.07) | B(7.0) | A | A | A | B |
| Comparative Example 1 | 4 | Suspension polymerization | 6.0 | 4 | B(0.07) | C(10.0) | A | A | A | C |
| Example 4 | 5 | Suspension polymerization | 6.5 | 5 | A(0.02) | A(1.5) | A | A | A | A |
| Example 5 | 6 | Suspension polymerization | 6.8 | 6 | A(0.03) | B(5.5) | A | A | A | A |
| Comparative Example 2 | 7 | Suspension polymerization | 6.3 | 7 | B(0.05) | B(6.0) | A | A | A | C |
| Example 6 | 8 | Suspension polymerization | 5.9 | 8 | A(0.02) | A(1.2) | A | A | A | A |
| Example 7 | 9 | Suspension polymerization | 6.5 | 9 | A(0.03) | B(5.5) | A | A | A | B |
| Example 8 | 10 | Suspension polymerization | 7.0 | 10 | A(0.04) | B(6.0) | A | A | A | B |
| Example 9 | 11 | Suspension polymerization | 6.5 | 11 | B(0.05) | B(7.5) | A | A | A | B |
| Example 10 | 12 | Suspension polymerization | 6.6 | 12 | B(0.07) | B(8.0) | A | A | A | B |
| Comparative Example 3 | 13 | Suspension polymerization | 6.1 | 13 | B(0.07) | C(11.0) | A | A | A | C |
| Comparative Example 4 | 14 | Suspension polymerization | 5.8 | 14 | B(0.08) | C(12.0) | A | A | A | C |
| Comparative Example 5 | 15 | Suspension polymerization | 5.8 | 15 | B(0.09) | C(12.0) | A | A | A | C |
| Comparative Example 6 | 16 | Suspension polymerization | 6.3 | 16 | C(0.11) | C(13.5) | B | A | A | D |
| Comparative Example 7 | 17 | Suspension polymerization | 6.5 | 17 | C(0.14) | C(14.0) | B | B | A | D |
| Example 11 | 18 | Emulsion aggregation | 6.4 | 1 | A(0.03) | A(1.5) | A | A | A | A |
| Example 12 | 19 | Pulverization | 6.6 | 1 | A(0.04) | A(1.0) | A | A | A | A |
| Comparative Example 8 | 20 | Suspension polymerization | 6.2 | 18 | D(0.17) | D(15.3) | C | B | A | D |
| Comparative Example 9 | 21 | Suspension polymerization | 6.0 | 19 | C(0.14) | D(15.0) | B | C | D | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-201067, filed Sep. 8, 2010, which is hereby incorporated by reference herein in its entirety.

The invention claimed is:

1. A toner comprising toner particles, each of which contains a binder resin, an ester wax, and a coloring agent, wherein in GC/MS analysis of components volatilized by heating the ester wax at 200° C. for 10 minutes, (1) a total amount (A) of components showing peaks that are detected on and after the detection time of the peak of hydrocarbon having 16 carbon atoms is 1000 ppm or less;

(2) a total amount (B) of components showing peaks that are detected on and after the detection time of the peak of hydrocarbon having 30 carbon atoms is 200 ppm or less;

(3) a total amount (C) of components showing peaks that are detected on and after the detection time of the peak of hydrocarbon having 16 carbon atoms and before the detection time of the peak of hydrocarbon having 24 carbon atoms is 300 ppm or less;

(4) the total amount (B) and the total amount (C) satisfy a relationship expressed by (C)/(B)≥1.0; and (5) a total amount (E) of components showing peaks that are detected before the detection time of the peak of hydrocarbon having 16 carbon atoms is 500 ppm or less.

2. The toner according to claim 1, wherein in the GC/MS analysis, when a total amount of components showing peaks that are detected on and after the detection time of the peak of hydrocarbon having 24 carbon atoms and before the detection time of the peak of hydrocarbon having 30 carbon atoms is represented by a total amount (D), the total amount (C) and the total amount (D) satisfy a relationship expressed by (C)/(D)≥0.5.

3. The toner according to claim 1, wherein the ester wax shows a peak width at half height of the maximum endothermic peak of 5° C. or less in an endothermic curve obtained by differential scanning calorimetry (DSC) measurement.

4. The toner according to claim 1, wherein the content of the ester wax is 1.0 part by mass or more and 25.0 parts by mass or less based on 100.0 parts by mass of the binder resin.

* * * * *